US010495295B2

(12) United States Patent
Van De Ven et al.

(10) Patent No.: US 10,495,295 B2
(45) Date of Patent: Dec. 3, 2019

(54) LIGHTING DEVICE, HEAT TRANSFER STRUCTURE AND HEAT TRANSFER ELEMENT

(71) Applicant: CREE, INC., Durham, NC (US)

(72) Inventors: Antony Paul Van De Ven, Hong Kong (CN); Gerald H. Negley, Durham, NC (US)

(73) Assignee: IDEAL Industries Lighting LLC, Sycamore, IL (US)

( * ) Notice: Subject to any disclaimer, the term of this patent is extended or adjusted under 35 U.S.C. 154(b) by 760 days.

(21) Appl. No.: 14/466,158

(22) Filed: Aug. 22, 2014

(65) Prior Publication Data

US 2014/0362582 A1 Dec. 11, 2014

Related U.S. Application Data

(62) Division of application No. 12/469,828, filed on May 21, 2009, now Pat. No. 8,858,032.

(Continued)

(51) Int. Cl.
*F21V 29/51* (2015.01)
*F28D 15/02* (2006.01)

(Continued)

(52) U.S. Cl.
CPC ..... *F21V 29/51* (2015.01); *F21K 9/00* (2013.01); *F21K 9/23* (2016.08); *F21K 9/60* (2016.08);

(Continued)

(58) Field of Classification Search
CPC ... F21K 9/00; F21K 9/13; F21K 9/137; F21K 9/50; F21S 4/28; F21V 13/04;

(Continued)

(56) References Cited

U.S. PATENT DOCUMENTS 4,473,872 A * 9/1984 Puckett ..... H01K 1/30 362/309
4,710,629 A * 12/1987 Muller ..... G08B 29/046 250/252.1

(Continued)

FOREIGN PATENT DOCUMENTS

CN 1 806 145 7/2006
CN 101191611 6/2008

(Continued)

OTHER PUBLICATIONS 2007-0139923 (U.S. Appl. No. 11/613,692), Jun. 21, 2007 (filed Dec. 20, 2006), Negley.

(Continued)

*Primary Examiner* — Tsion Tumebo
(74) *Attorney, Agent, or Firm* — Burr & Brown, PLLC

(57) ABSTRACT

A heat pipe configured to transfer heat from a central portion of a lighting device to an edge portion of the lighting device, the heat pipe comprising one region which extends along a portion of a diameter of a substantially circular, substantially annular shape and another region that extends along a diameter of the shape. Also, a lighting device comprising a housing, a reflector, a light emitter and a heat pipe as described above. Also, a self ballasted lamp comprising a solid state light source, an electrical connector, an AC power supply, a reflector configured to receive light from the source and emit reflected light from an aperture, and a thermal management system. Also, a lighting device, comprising a housing, a reflector, a light emitter comprising an array of solid state light emitters, a heat pipe and a sensor.

28 Claims, 7 Drawing Sheets

Related U.S. Application Data

(60) Provisional application No. 61/108,149, filed on Oct. 24, 2008.

(51) Int. Cl.

| | |
|---|---|
| ***F21V 7/00*** | (2006.01) |
| ***F21V 13/04*** | (2006.01) |
| ***F21V 23/06*** | (2006.01) |
| ***F21K 9/00*** | (2016.01) |
| ***F21K 9/23*** | (2016.01) |
| ***F21K 9/60*** | (2016.01) |
| ***F21K 9/68*** | (2016.01) |
| ***F21K 9/233*** | (2016.01) |
| ***F21S 4/28*** | (2016.01) |
| *F21V 7/06* | (2006.01) |
| *F21Y 115/10* | (2016.01) |

(52) U.S. Cl.
CPC *F21K 9/68* (2016.08); *F21S 4/28* (2016.01); *F21V 7/0008* (2013.01); *F21V 7/0066* (2013.01); *F21V 13/04* (2013.01); *F21V 23/06* (2013.01); *F28D 15/0266* (2013.01); *F21K 9/233* (2016.08); *F21V 7/06* (2013.01); *F21Y 2115/10* (2016.08)

(58) Field of Classification Search
CPC ..... F21V 23/06; F21V 29/006; F21V 29/51; F21V 7/0008; F21V 7/0066; F21V 7/06; F21Y 2101/02; F28D 15/0266
USPC ..... 362/294, 373, 318, 249.01, 257, 547
See application file for complete search history.

(56) References Cited

U.S. PATENT DOCUMENTS

| | | | | |
|---|---|---|---|---|
| 4,918,487 | A | 4/1990 | Coulter, Jr. | |
| 4,956,547 | A | 9/1990 | Mita | |
| 5,200,022 | A | 4/1993 | Kong et al. | |
| 5,472,915 | A * | 12/1995 | Schairer | H01L 33/60 257/E31.128 |
| 5,631,190 | A | 5/1997 | Negley | |
| 5,912,477 | A | 6/1999 | Negley | |
| 5,924,785 | A | 7/1999 | Zhang et al. | |
| 5,951,415 | A | 9/1999 | Gates et al. | |
| 6,149,283 | A | 11/2000 | Conway et al. | |
| 6,439,888 | B1 | 8/2002 | Boutoussov et al. | |
| 6,578,998 | B2 | 6/2003 | Zhang | |
| 6,583,151 | B2 | 6/2003 | Nagase et al. | |
| 6,600,175 | B1 | 7/2003 | Baretz et al. | |
| 6,637,921 | B2 | 10/2003 | Coushaine | |
| 6,672,741 | B1 * | 1/2004 | Young | F21L 4/027 362/307 |
| 6,722,777 | B2 | 4/2004 | Erber | |
| 6,762,562 | B2 | 7/2004 | Leong | |
| 6,767,112 | B2 | 7/2004 | Wu | |
| 6,811,277 | B2 | 11/2004 | Amano | |
| 6,846,101 | B2 | 1/2005 | Coushaine | |
| 6,853,151 | B2 | 2/2005 | Leong et al. | |
| 6,893,140 | B2 | 5/2005 | Storey et al. | |
| 6,899,443 | B2 | 5/2005 | Rizkin et al. | |
| 6,945,672 | B2 | 9/2005 | Du et al. | |
| 7,001,047 | B2 | 2/2006 | Holder et al. | |
| 7,097,334 | B2 | 2/2006 | Ishida et al. | |
| 7,011,431 | B2 | 3/2006 | Ono et al. | |
| 7,029,150 | B2 | 4/2006 | Finch | |
| 7,067,992 | B2 | 6/2006 | Leong et al. | |
| 7,121,691 | B2 | 8/2006 | Coushaine et al. | |
| 7,131,760 | B2 | 11/2006 | Mayer et al. | |
| 7,178,937 | B2 | 2/2007 | McDermott | |
| 7,213,940 | B1 | 5/2007 | Van De Ven et al. | |
| 7,214,952 | B2 | 5/2007 | Klipstein et al. | |
| 7,230,280 | B2 | 6/2007 | Yaw et al. | |
| 7,246,921 | B2 * | 7/2007 | Jacobson | F21K 9/00 362/294 |
| 7,270,448 | B1 | 9/2007 | Maley, Sr. | |
| 7,547,124 | B2 | 6/2009 | Chang et al. | |
| 7,569,802 | B1 * | 8/2009 | Mullins | F21V 23/0442 250/205 |
| 7,699,494 | B2 | 4/2010 | Catalano et al. | |
| 7,942,540 | B2 | 5/2011 | Harbers et al. | |
| 7,942,556 | B2 | 5/2011 | Harbers et al. | |
| 7,946,735 | B2 * | 5/2011 | Chou | F21K 9/68 362/294 |
| 8,556,438 | B2 * | 10/2013 | McKenzie | F21K 9/00 257/103 |
| 2002/0136025 | A1 | 9/2002 | Zhang | |
| 2003/0034985 | A1 * | 2/2003 | Needham Riddle | G01J 1/08 345/589 |
| 2003/0063475 | A1 | 4/2003 | Simmons | |
| 2004/0155565 | A1 | 8/2004 | Holder et al. | |
| 2005/0007768 | A1 | 1/2005 | Holder et al. | |
| 2005/0092469 | A1 | 5/2005 | Huang | |
| 2005/0152127 | A1 | 7/2005 | Kamiya et al. | |
| 2006/0163990 | A1 * | 7/2006 | Huizar | F21V 7/22 313/113 |
| 2006/0164836 | A1 * | 7/2006 | Suehiro | F21K 9/00 362/294 |
| 2006/0262524 | A1 | 11/2006 | Kah, Jr. | |
| 2007/0045524 | A1 | 3/2007 | Rains, Jr. et al. | |
| 2007/0053179 | A1 | 3/2007 | Pang et al. | |
| 2007/0091607 | A1 | 4/2007 | Powell | |
| 2007/0189017 | A1 | 8/2007 | Hofmann | |
| 2007/0223219 | A1 | 9/2007 | Medendorp, Jr. | |
| 2007/0236935 | A1 | 10/2007 | Wang | |
| 2008/0074885 | A1 | 3/2008 | Brands et al. | |
| 2008/0093530 | A1 | 4/2008 | Hoelen et al. | |
| 2008/0117637 | A1 * | 5/2008 | Chang | F28D 15/0266 362/294 |
| 2008/0130288 | A1 * | 6/2008 | Catalano | H05B 33/0803 362/294 |
| 2008/0142816 | A1 | 6/2008 | Bierhuizen et al. | |
| 2008/0186704 | A1 * | 8/2008 | Chou | F21V 31/005 362/249.01 |
| 2009/0040760 | A1 | 2/2009 | Chen et al. | |
| 2009/0103296 | A1 * | 4/2009 | Harbers | F21V 7/22 362/234 |
| 2009/0290349 | A1 * | 11/2009 | Chu | F21V 7/0008 362/249.02 |
| 2010/0128479 | A1 | 5/2010 | Biebl et al. | |

FOREIGN PATENT DOCUMENTS

| | | |
|---|---|---|
| JP | 63-021474 | 1/1988 |
| JP | 07-282609 | 10/1995 |
| JP | 2001-148510 | 5/2001 |
| JP | 2003-529889 | 10/2003 |
| JP | 2004-029141 | 1/2004 |
| JP | 2004-127716 | 4/2004 |
| JP | 2004-172507 | 6/2004 |
| JP | 2005-183193 | 7/2005 |
| JP | 2006-179450 | 7/2006 |
| JP | 2006-237282 | 9/2006 |
| JP | 2006-313271 | 11/2006 |
| JP | 2007-073968 | 3/2007 |
| JP | 2007-235079 | 9/2007 |
| JP | 2007-266579 | 10/2007 |
| JP | 2008-140717 | 6/2008 |
| JP | 2008-154541 | 7/2008 |
| JP | 2010-524210 | 7/2010 |
| WO | 00/19546 | 4/2000 |
| WO | 2007/142948 | 12/2007 |
| WO | 2008/067447 | 6/2008 |
| WO | 2008/119392 | 10/2008 |

OTHER PUBLICATIONS 2007-0236911 (U.S. Appl. No. 11/614,180), Oct. 11, 2007 (filed Dec. 21, 2006), Negley.

(56) References Cited

OTHER PUBLICATIONS 2007-0137074 (U.S. Appl. No. 11/613,733), Jun. 21, 2007 (filed Dec. 20, 2006), Van de Ven.
2007-0170447 (U.S. Appl. No. 11/624,811), Jul. 26, 2007 (filed Jan. 19, 2007), Negley.
2007-0171145 (U.S. Appl. No. 11/626,483), Jul. 26, 2007 (filed Jan. 24, 2007), Coleman.
2007-0263393 (U.S. Appl. No. 11/743,754), Nov. 15, 2007 (filed May 3, 2007), Van de Ven.
2007-0274080 (U.S. Appl. No. 11/751,982), Nov. 29, 2007 (filed May 22, 2007), Negley.
2007-0280624 (U.S. Appl. No. 11/753,103), Dec. 6, 2007 (filed May 24, 2007), Negley.
2007-0274063 (U.S. Appl. No. 11/751,990), Nov. 29, 2007 (filed May 22, 2007), Negley.
2007-0278934 (U.S. Appl. No. 11/736,761), Dec. 6, 2007 (filed Apr. 18, 2007), Van de Ven.
2007-0279903 (U.S. Appl. No. 11/755,153), Dec. 6, 2007 (filed May 30, 2007), Negley.
2007-0279440 (U.S. Appl. No. 11/755,162), Dec. 6, 2007 (filed May 30, 2007), Negley.
2008-0084700 (U.S. Appl. No. 11/856,421), Apr. 10, 2008 (filed Sep. 17, 2007), Van de Ven.
2008-0088248 (U.S. Appl. No. 11/854,744), Apr. 17, 2008 (filed Sep. 13, 2007), Myers.
2008-0084701 (U.S. Appl. No. 11/859,048), Apr. 10, 2008 (filed Sep. 21, 2007), Van de Ven.
2008-0112183 (U.S. Appl. No. 11/939,047), May 15, 2008 (filed Nov. 13, 2007), Negley.
2008-0106895 (U.S. Appl. No. 11/936,163), May 8, 2008 (filed Nov. 7, 2007), Van de Ven.
2008-0084685 (U.S. Appl. No. 11/843,243), Apr. 10, 2008 (filed Aug. 22, 2007), Van de Ven.
2008-0112168 (U.S. Appl. No. 11/939,052), May 15, 2008 (filed Nov. 13, 2007), Pickard.
2008-0112170 (U.S. Appl. No. 11/939,059), May 15, 2008 (filed Nov. 13, 2007), Trott.
2008-0106907 (U.S. Appl. No. 11/877,038), May 8, 2008 (filed Oct. 23, 2007), Trott.
2009-0184616 (U.S. Appl. No. 12/248,220), Jul. 23, 2009 (filed Oct. 9, 2008), Van de Ven.
2008-0089053 (U.S. Appl. No. 11/870,679), Apr. 17, 2008 (filed Oct. 11, 2007), Negley.
2008-0130298 (U.S. Appl. No. 11/947,392), Jun. 5, 2008 (filed Nov. 29, 2007), Negley.
2008-0137347 (U.S. Appl. No. 11/948,041), Jun. 12, 2008 (filed Nov. 30, 2007), Trott.
2008-0304269 (U.S. Appl. No. 12/114,994), Dec. 11, 2008 (filed May 5, 2008), Pickard.
2008-0278952 (U.S. Appl. No. 12/116,341), Nov. 13, 2008 (filed May 7, 2008), Trott.
2008-0304261 (U.S. Appl. No. 12/117,148), Dec. 11, 2008 (filed May 8, 2008), Van de Ven.
2008-0309255 (U.S. Appl. No. 12/117,280), Dec. 18, 2008 (filed May 8, 2008), Myers.
2009-0108269 (U.S. Appl. No. 12/017,676), Apr. 30, 2009 (filed Jan. 22, 2008), Negley.
2009-0184666 (U.S. Appl. No. 12/328,144), Jul. 23, 2009 (filed Dec. 4, 2008), Myers.
2008-0278950 (U.S. Appl. No. 12/116,346), Nov. 13, 2008 (filed May 7, 2008), Pickard.
2008-0278957 (U.S. Appl. No. 12/116,348), Nov. 13, 2008 (filed May 7, 2008), Pickard.
2008-0173884 (U.S. Appl. No. 11/656,759), Jul. 24, 2008 (filed Jan. 22, 2002), Chitnis et al.
2008-0179611 (U.S. Appl. No. 11/899,790), Jul. 31, 2008 (filed Sep. 7, 2007), Chitnis et al.
2007-0158668 (U.S. Appl. No. 11/473,089), Jul. 12, 2007 (filed Jun. 21, 2006), Tarsa et al.
2010-0102697 (U.S. Appl. No. 12/512,653), Apr. 29, 2010 (filed Jul. 30, 2009), Van de Ven.
2009-0160363 (U.S. Appl. No. 12/257,804), Jun. 25, 2009 (filed Oct. 24, 2008), Negley.
2009/0283779 (U.S. Appl. No. 12/475,261), Nov. 19, 2009 (filed May 29, 2009), Negley.
U.S. Appl. No. 29/379,208, filed Nov. 16, 2010, Van de Ven et al.
U.S. Appl. No. 12/886,718, filed Sep. 21, 2010, Van de Ven et al.
Japanese Office Action (and translation provided by foreign counsel) dated Jul. 22, 2014, 8 pages.
Japanese Office Action (and translation provided foreign counsel) from a corresponding Japanese patent application dated Jul. 22, 2014, 8 pages.
Invitation to Pay Additional Fees and, Where Applicable, Protest Fee from a corresponding International patent application dated Nov. 19, 2009, 6 pages.
International Search Report and Written Opinion from a corresponding International patent application dated Mar. 8, 2010, 18 pages.
Australian Notice of Acceptance from a corresponding Australian patent application dated Nov. 11, 2011, 3 pages.
Chinese Office Action (and translation provided foreign counsel) from a corresponding Chinese patent application dated Sep. 7, 2012, 8 pages.
Japanese Office Action (and translation provided foreign counsel) from a corresponding Japanese patent application dated Nov. 5, 2012, 7 pages.
Australian Patent Examination Report 1 from a corresponding Australian patent application dated Nov. 5, 2012, 4 pages.
Japanese Office Action (and translation provided by foreign counsel) from a corresponding Japanese patent application dated Mar. 9, 2015, 7 pages.
Korean Office Action (and translation provided by foreign counsel) from a corresponding Korean patent application dated Jun. 30, 2015, 10 pages.
Taiwan Office Action (and translation provided by foreign counsel) from a corresponding Taiwan patent application dated May 27, 2015, 16 pages.

* cited by examiner

Fig. 7a
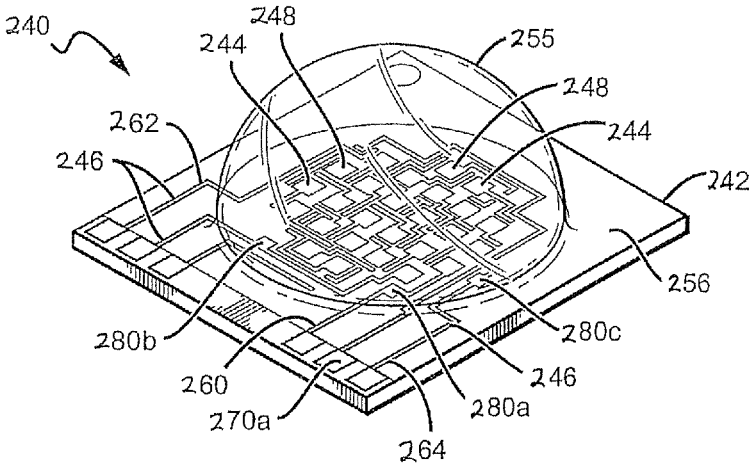
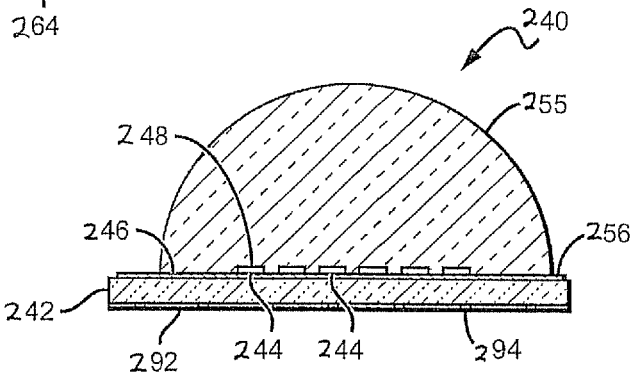
Fig. 7b
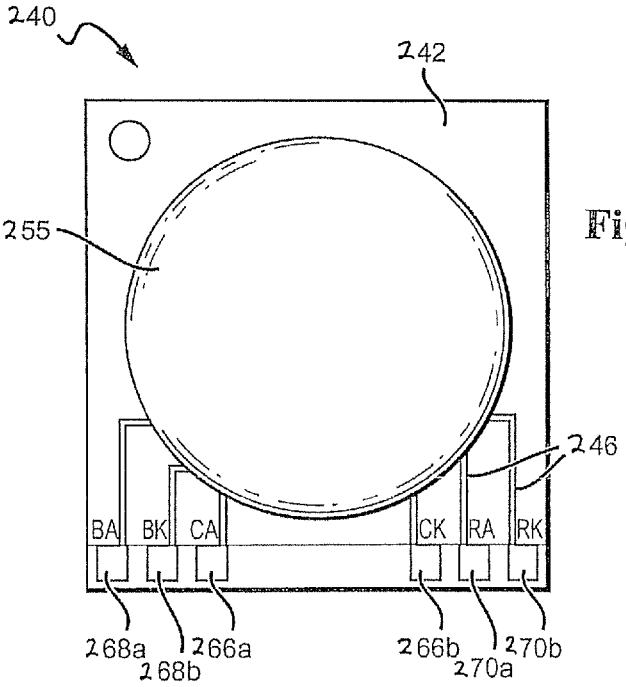
Fig. 7c

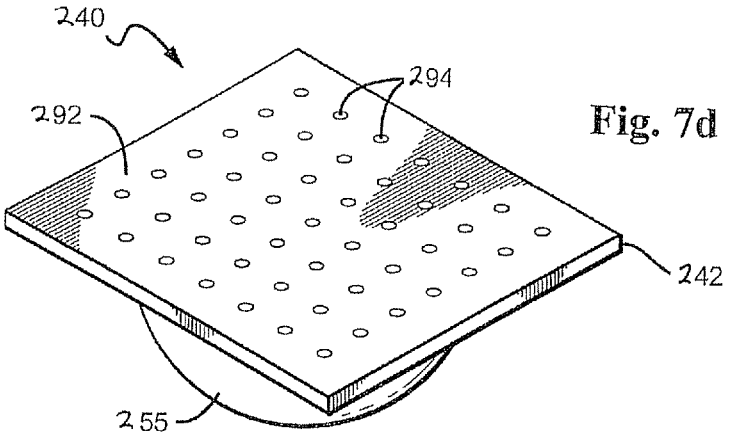
Fig. 7d
Fig. 7e
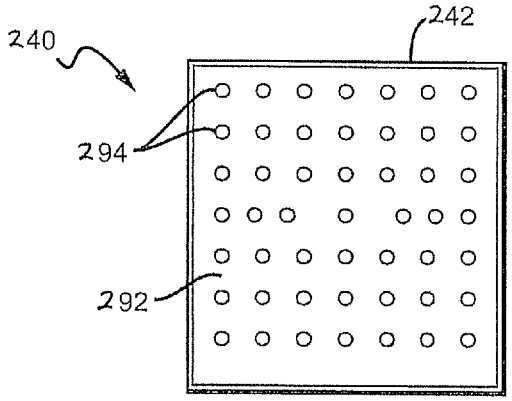
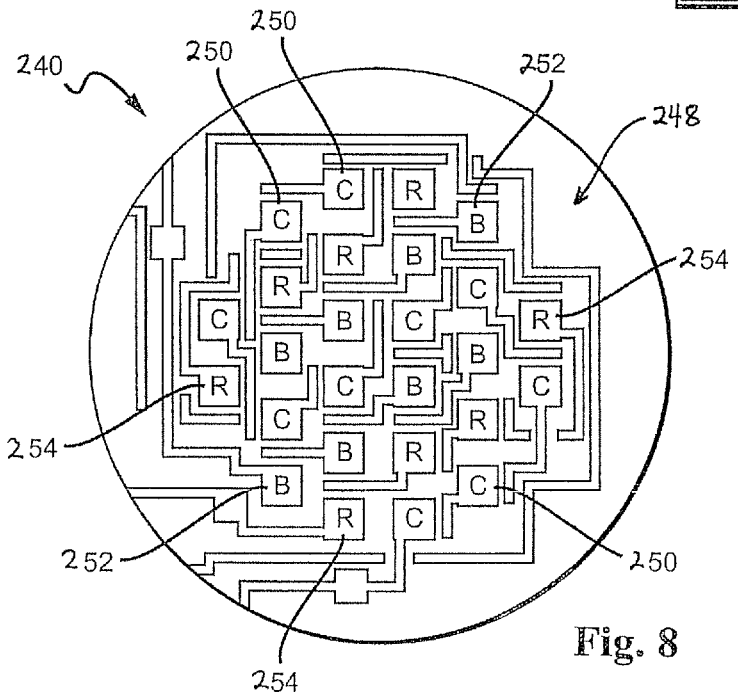
Fig. 8

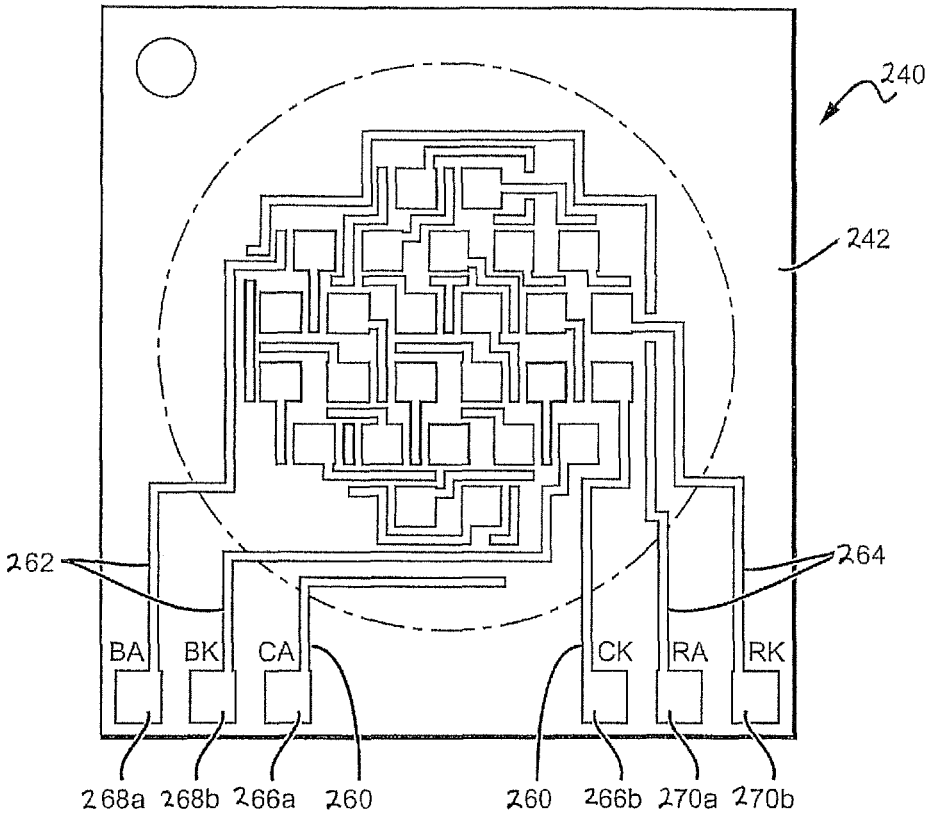
Fig. 9
Fig. 12
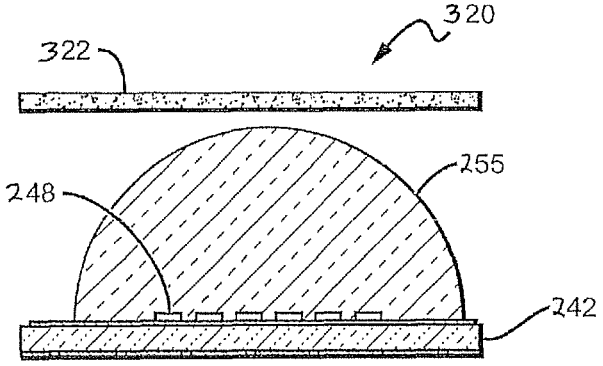

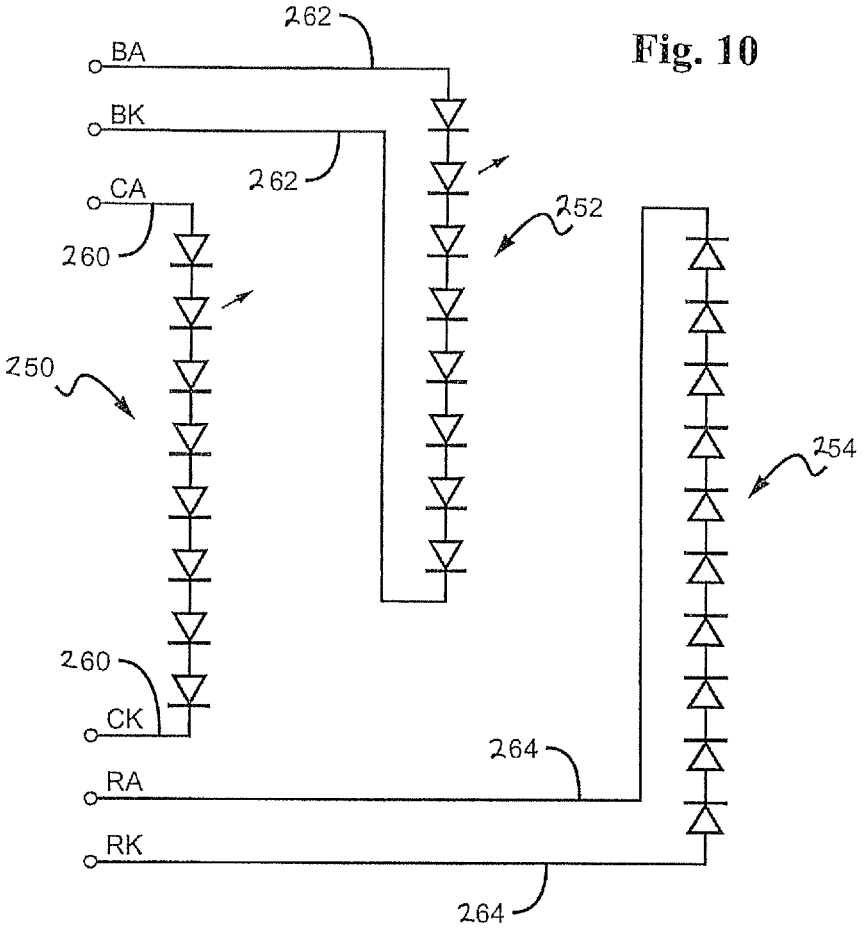
Fig. 10
Fig. 11
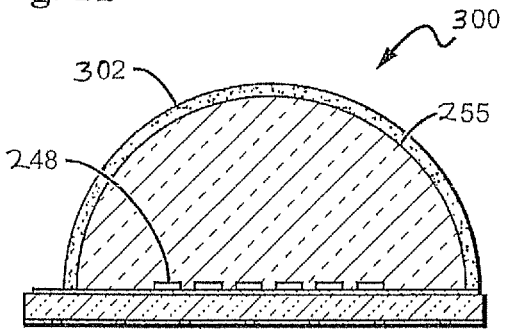

LIGHTING DEVICE, HEAT TRANSFER STRUCTURE AND HEAT TRANSFER ELEMENT

CROSS-REFERENCE TO RELATED APPLICATION

This application is a division of U.S. patent application Ser. No. 12/469,828, filed May 21, 2009, the entirety of which is incorporated herein by reference as if set forth in its entirety.

This application claims the benefit of U.S. Provisional Patent Application No. 61/108,149, filed Oct. 24, 2008, the entirety of which is incorporated herein by reference.

FIELD OF THE INVENTIVE SUBJECT MATTER

Some aspects of the present inventive subject matter relate to lighting devices, more particularly, to lighting devices which comprise a housing, a light emitter, a reflector, a heat transfer element and a sensor. Some aspects of the present inventive subject matter relate to heat transfer elements which each comprise a heat pipe. Some aspects of the present inventive subject matter relate to heat transfer structures which each comprise a heat transfer element and a heat rim.

BACKGROUND

A large proportion (some estimates are as high as twenty-five percent) of the electricity generated in the United States each year goes to lighting. Accordingly, there is an ongoing need to provide lighting which is more energy-efficient.

It is well known, however, that any proposed new (or existing) lighting device must adequately deal with heat generated by the light source employed in the lighting device. The present inventive subject matter provides heat transfer structures and heat transfer elements which assist in addressing heat generation issues in lighting devices, and lighting devices which include such heat transfer structures and heat transfer elements.

Light sources which are showing great promise are solid state light emitters, e.g., light emitting diodes. It is well known that incandescent light bulbs are very energy-inefficient light emitters—about ninety percent of the electricity they consume is released as heat rather than light. Fluorescent light bulbs are more efficient than incandescent light bulbs (by a factor of about 10) but are still less efficient than solid state light emitters, such as light emitting diodes.

In addition, as compared to the normal lifetimes of solid state light emitters, e.g., light emitting diodes, incandescent light bulbs have relatively short lifetimes, i.e., typically about 750-1000 hours. In comparison, light emitting diodes, for example, have typical lifetimes between 50,000 and 70,000 hours. Fluorescent bulbs have longer lifetimes (e.g., 10,000-20,000 hours) than incandescent lights, but provide less favorable color reproduction.

Another issue faced by conventional light fixtures is the need to periodically replace the lighting devices (e.g., light bulbs, etc.). Such issues are particularly pronounced where access is difficult (e.g., vaulted ceilings, bridges, high buildings, traffic tunnels) and/or where change-out costs are extremely high. The typical lifetime of conventional fixtures is about 20 years, corresponding to a light-producing device usage of at least about 44,000 hours (based on usage of 6 hours per day for 20 years). Light-producing device lifetime is typically much shorter, thus creating the need for periodic change-outs.

Accordingly, for these and other reasons, efforts have been ongoing to develop ways by which solid state light emitters can be used in place of incandescent lights, fluorescent lights and other light-generating devices in a wide variety of applications. In addition, where light emitting diodes (or other solid state light emitters) are already being used, efforts are ongoing to provide light emitting diodes (or other solid state light emitters) which are improved, e.g., with respect to energy efficiency, efficacy (lm/W), and/or duration of service.

The need to adequately remove heat generated by the light source is particularly pronounced with respect to solid state light emitters. LED light sources, for example, have operating lifetimes of decades (as opposed to just months or one or two years for many incandescent bulbs), but an LED's lifetime is usually significantly shortened if it operates at elevated temperatures. It is generally accepted that the junction temperature of an LED should not exceed 85 degrees C. if a long lifetime is desired.

In addition, the intensity of light emitted from some solid state light emitters varies based on ambient temperature. For example, LEDs which emit red light often have a very strong temperature dependence (e.g., AlInGaP LEDs can reduce in optical output by ~20% when heated up by ~40 degrees C., that is, approximately −0.5% per degree C.; and Blue InGaN+YAG:Ce LEDs can reduce by about −0.15%/degree C.).

As is well known, in many instances where lighting devices include solid state light emitters as light sources (e.g., general illumination devices which emit white light in which the light sources consist of light emitting diodes), a plurality of solid state light emitters are provided which emit light of different colors which, when mixed, are perceived as the desired color for the output light (e.g., white or near-white). As noted above, the intensity of light emitted by many solid state light emitters, when supplied with a given current, can vary as a result of temperature change. The desire to maintain a relatively stable color of light output is therefore an important reason to try to reduce temperature variation of solid state light emitters.

In addition, the potential for variation in intensity of solid state light emitters (e.g., depending on the ambient temperature and/or the age of the solid state light emitter) has in many instances led to the inclusion in some lighting devices which include solid state light emitter of one or more sensors which detect (1) the color of the light being emitted from the lighting device, and/or (2) the intensity of the light being emitted from one or more of the solid state light emitters, and/or (3) the intensity of light of one or more specific hues of color. By providing such sensors, it is possible to adjust the current supplied to one or more of the solid state light emitters, based on the readings from such sensor(s), in order to maintain the color of the output light within a desired range of color.

BRIEF SUMMARY OF THE INVENTIVE SUBJECT MATTER

In accordance with a first aspect of the present inventive subject matter, there is provided a lighting device, comprising:

a housing;

at least one reflector;

at least one heat transfer element;

at least one light emitter; and the light emitter being mounted on the heat transfer element, the heat transfer element being in thermal contact with the housing.

In some embodiments according to this aspect of the present inventive subject matter the heat transfer element is as described below in connection with the second aspect of the present inventive subject matter, and/or the housing comprises a heat rim as described below in connection with the third aspect of the present inventive subject matter.

In accordance with a second aspect of the present inventive subject matter, there is provided a heat transfer element, comprising:

a heat pipe, the heat pipe comprising a thermal transfer region and at least a first thermal exchange region, at least a portion of the first thermal exchange region extending in a shape which comprises at least a first portion of a substantially circular substantially annular shape, at least a portion of the thermal transfer region extending in a shape which comprises at least a portion of a diameter of the substantially circular substantially annular shape.

In some embodiments according to the second aspect of the present inventive subject matter, the portion of the first thermal exchange region extends at least 10 degrees along the first portion of the substantially circular substantially annular shape, and in some embodiments, the portion of the first thermal exchange region extends at least 20 degrees (and in some cases at least 30 degrees, at least 40 degrees, at least 50 degrees, at least 60 degrees, at least 70 degrees, at least 80 degrees, at least 90 degrees, at least 100 degrees, at least 110 degrees, at least 120 degrees, at least 130 degrees, at least 140 degrees, at least 150 degrees, at least 160 degrees, at least 170 degrees, or at least about 180 degrees) along the first portion of the substantially circular substantially annular shape.

In some embodiments according to the second aspect of the present inventive subject matter, the thermal transfer region extends substantially radially relative to the substantially circular substantially annular shape.

In some embodiments according to the second aspect of the present inventive subject matter, the heat pipe further comprises a second thermal exchange region, and at least a portion of the second thermal exchange region extends in a shape which comprises a second portion of the substantially circular substantially annular shape. In some of such embodiments, (1) said portion of the first thermal exchange region extends at least 10 degrees along the first portion of the substantially circular substantially annular shape, and said portion of the second thermal exchange region extends at least 10 degrees along the second portion of the substantially circular substantially annular shape, and/or (2) the portion of the first thermal exchange region extends in a first circumferential direction relative to the substantially circular substantially annular shape, and the portion of the second thermal exchange region also extends in the first circumferential direction.

In some embodiments according to the second aspect of the present inventive subject matter, the heat transfer element further comprises a heat plate, and the heat plate is in thermal contact with the thermal transfer region of the heat pipe. In some of such embodiments, (1) at least a first light emitter is mounted on the heat plate, and/or (2) the heat plate comprises a heat plate groove, and a portion of the thermal transfer region extends along at least a portion of the heat plate groove.

In accordance with a third aspect of the present inventive subject matter, there is provided a heat transfer structure, comprising:

a heat transfer element; and a heat rim, the heat transfer element comprising a heat pipe, the heat pipe comprising a thermal transfer region and at least a first thermal exchange region, the first thermal exchange region being in thermal contact with the heat rim, at least a portion of the heat rim being of a shape which comprises at least a portion of a substantially annular shape.

In some embodiments according to the third aspect of the present inventive subject matter, the first substantially annular shape is substantially circular. In some of such embodiments, (1) the thermal transfer region extends substantially diametrically relative to the first substantially annular shape, and/or (2) the thermal transfer region extends substantially radially relative to the first substantially annular shape.

In some embodiments according to the third aspect of the present inventive subject matter, the first substantially annular shape is substantially circular, and at least a portion of the first thermal exchange region extends substantially circumferentially along a first portion of the substantially circular substantially annular shape. In some of such embodiments, the portion of the first thermal exchange region extends along the first heat rim for at least 10 degrees of the first portion of the substantially circular substantially annular shape.

In some embodiments according to the third aspect of the present inventive subject matter, the first substantially annular shape is substantially circular, and the heat pipe further comprises a second thermal exchange region. In some of such embodiments, (1) at least a portion of the first thermal exchange region extends substantially circumferentially along a first portion of the substantially circular substantially annular shape and (2) at least a portion of the second thermal exchange region extends substantially circumferentially along a second portion of the substantially circular substantially annular shape. In some of such embodiments, said portion of the first thermal exchange region extends at least 10 degrees along the first portion of the substantially circular substantially annular shape, and said portion of the second thermal exchange region extends at least 10 degrees along the second portion of the substantially circular substantially annular shape.

In some embodiments according to the third aspect of the present inventive subject matter, the heat rim has at least a first heat rim groove, and at least a portion of the first thermal exchange region extends along at least a portion of the first heat rim groove. In some of such embodiments, (1) at least a portion of the heat rim is of a shape which comprises at least a portion of a substantially circular substantially annular shape, and (2) the portion of the first thermal exchange region extends along the first heat rim groove for at least 10 degrees along the substantially circular substantially annular shape.

In some embodiments according to the third aspect of the present inventive subject matter, the heat transfer element further comprises a heat plate, and the heat plate is in thermal contact with the thermal transfer region of the heat pipe. In some of such embodiments, the heat plate comprises a heat plate groove, and a portion of the thermal transfer region extends along at least a portion of the heat plate groove, and/or at least a first light emitter is mounted on the heat plate.

In accordance with a fourth aspect of the present inventive subject matter, there is provided a lighting device, comprising:

a housing;

a reflector disposed within the housing;

a light emitter comprising an array of solid state light emitters;

a heat pipe in thermal communication with the light emitter and the housing; and at least one sensor, the sensor being positioned within a region which receives direct light from the light emitter when the light emitter is emitting light.

In accordance with the fourth aspect of the present inventive subject matter, the solid state light emitters included in the array of solid state light emitters each emit light which combines to provide the desired emission characteristics. The solid state light emitters are discrete light sources which may be arranged pursuant to a guideline described below in paragraphs (1)-(5), or any combination of two or more thereof, to promote mixing of light from light sources emitting different colors of light.

(1) In some embodiments according to the fourth aspect of the present inventive subject matter, the array has groups of first and second LED chips with the first group of LED chips arranged so that no two of the first group LED chips are directly next to one another in the array.

(2) In some embodiments according to the fourth aspect of the present inventive subject matter, the array comprises a first group of LED chips and one or more additional groups of LED chips, the first group of LEDs being arranged so that at least three LED chips from the one or more additional groups is adjacent each of the LED chips in the first group.

(3) In some embodiments according to the fourth aspect of the present inventive subject matter, (a) the array is mounted on a submount, (b) the array comprises a first group of LED chips and one or more additional groups of LED chips, and (c) the array is arranged so that less than fifty percent (50%), or as few as possible, of the LED chips in the first group of LED chips are on the perimeter of the array.

(4) In some embodiments according to the fourth aspect of the present inventive subject matter, (a) the array comprises a first group of LED chips and one or more additional groups of LED chips, and (b) the first group of LED ships is arranged so that no two LED chips from the first group are directly next to one another in the array, and so that at least three LED chips from the one or more additional groups is adjacent each of the LED chips in the first group.

(5) In some embodiments according to the fourth aspect of the present inventive subject matter, the array is arranged so that (a) no two LED chips from the first group are directly next to one another in the array, (b) fewer than fifty percent (50%) of the LED chips in the first group of LEDs are on the perimeter of the array, and (c) at least three LED chips from the one or more additional groups is adjacent each of the LED chips in the first group.

In some embodiments according to the fourth aspect of the present inventive subject matter, a lens is included over at least a portion of the array.

In some embodiments according to the fourth aspect of the present inventive subject matter, the housing comprises a substantially circular, substantially annular portion.

In some embodiments according to the fourth aspect of the present inventive subject matter, the sensor is positioned within a conical region bounded by lines which each define an angle of ten degrees or less relative to an axis of direct light emitted by the light emitter when the light emitter is emitting light.

As noted above, many lighting devices which include solid state light emitters include one or more sensors, e.g., in order to assist in causing the lighting device to emit light of a desired color (which may be constant, adjustable or variable). In many cases, however, readings obtained from sensors are inaccurate for any of a variety of reasons.

For example, in some cases, ambient light is received by the sensor(s) in addition to light from the light emitter(s), and the intensity of the ambient light as received by the sensor(s), relative to the intensity of the light from the light emitter(s), is sufficiently large to adversely affect the accuracy of the reading by the sensor(s) to a significant degree.

In other cases, the sensor(s) is sensitive to only some color hues, and so the sensor(s) senses the intensity of those color hues (e.g., the color(s) of those solid state light emitters which are most likely to decrease in intensity over time and/or with elevated temperature). In such cases, if an object (e.g., a white sheet of paper) is positioned close to the lighting device, the intensity of all color hues, including those to which the sensor(s) is sensitive will increase, thereby adversely affecting the accuracy of the reading by the sensor(s).

The inventive subject matter may be more fully understood with reference to the accompanying drawings and the following detailed description of the inventive subject matter.

BRIEF DESCRIPTION OF THE DRAWING FIGURES

Figure 1:
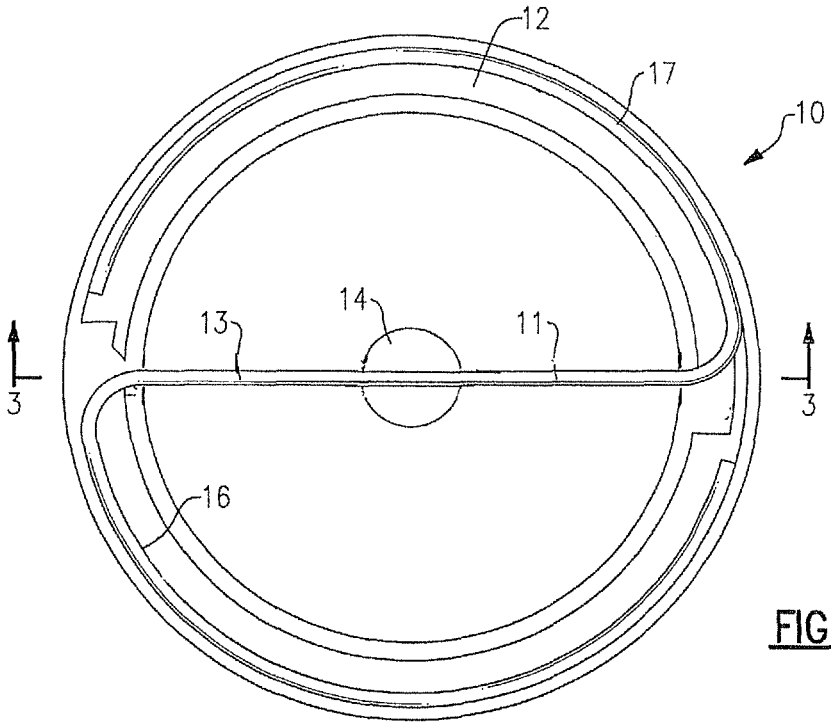
FIG. 1 is a top view of a first embodiment of a heat transfer structure according to the present inventive subject matter.

FIG. 7*a* shows a perspective view of one embodiment of an LED component comprising an array, according to the fourth aspect of the present invention;

FIG. 7*b* is a sectional view of side view of the LED component shown in FIG. 7*a;*

FIG. 7*c* is a top plan view of the LED component shown in FIG. 7*a;*

FIG. 7*d* is a bottom perspective view of the LED component shown in FIG. 7*a;*

FIG. 7*e* is a bottom plan view of the LED component shown in FIG. 7*a;*

FIG. 8 is a top plan view of one embodiment of an LED chip array layout according to the fourth aspect of the present invention.

FIG. 9 is a top plan view of one embodiment of a die attach pad and interconnect trace arrangement according to the fourth aspect of the present invention;

FIG. 10 is schematic showing one embodiment of interconnects for the LED array according to the fourth aspect of the present invention;

FIG. 11 is a side view of one embodiment of an LED component according to the fourth aspect of the present invention having a diffuser; and FIG. 12 is a side view of another embodiment of an LED component according to the fourth aspect of the present invention having a diffuser.

DETAILED DESCRIPTION OF THE INVENTIVE SUBJECT MATTER

The present inventive subject matter now will be described more fully hereinafter with reference to the accompanying drawings, in which embodiments of the inventive subject matter are shown. However, this inventive subject matter should not be construed as limited to the embodiments set forth herein. Rather, these embodiments are provided so that this disclosure will be thorough and complete, and will fully convey the scope of the inventive subject matter to those skilled in the art. Like numbers refer to like elements throughout. As used herein the term "and/or" includes any and all combinations of one or more of the associated listed items.

The terminology used herein is for the purpose of describing particular embodiments only and is not intended to be limiting of the inventive subject matter. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

When an element such as a layer, region or substrate is referred to herein as being "on" or extending "onto" another element, it can be directly on or extend directly onto the other element or intervening elements may also be present. In contrast, when an element is referred to herein as being "directly on" or extending "directly onto" another element, there are no intervening elements present. Also, when an element is referred to herein as being "connected" or "coupled" to another element, it can be directly connected or coupled to the other element or intervening elements may be present. In contrast, when an element is referred to herein as being "directly connected" or "directly coupled" to another element, there are no intervening elements present. In addition, a statement that a first element is "on" a second element is synonymous with a statement that the second element is "on" the first element.

Although the terms "first", "second", etc. may be used herein to describe various elements, components, regions, layers, sections and/or parameters, these elements, components, regions, layers, sections and/or parameters should not be limited by these terms. These terms are only used to distinguish one element, component, region, layer or section from another region, layer or section. Thus, a first element, component, region, layer or section discussed below could be termed a second element, component, region, layer or section without departing from the teachings of the present inventive subject matter.

Relative terms, such as "lower" or "bottom" and "upper" or "top," may be used herein to describe a relationship of one element to another element as illustrated in the Figures. Such relative terms are intended to encompass different orientations of the device in addition to the orientation depicted in the Figures. For example, if the device in the Figures is turned over, elements described as being on the "lower" side of other elements would then be oriented on "upper" sides of the other elements. The exemplary term "lower", can therefore, encompass both an orientation of "lower" and "upper," depending on the particular orientation of the figure. Similarly, if the device in one of the figures is turned over, elements described as "below" or "beneath" other elements would then be oriented "above" the other elements. The exemplary terms "below" or "beneath" can, therefore, encompass both an orientation of above and below.

The expression "lighting device", as used herein, is not limited, except that it is capable of emitting light. That is, a lighting device can be a device which illuminates an area or volume, e.g., a structure, a swimming pool or spa, a room, a warehouse, an indicator, a road, a parking lot, a vehicle, signage, e.g., road signs, a billboard, a ship, a toy, a mirror, a vessel, an electronic device, a boat, an aircraft, a stadium, a computer, a remote audio device, a remote video device, a cell phone, a tree, a window, an LCD display, a cave, a tunnel, a yard, a lamppost, or a device or array of devices that illuminate an enclosure, or a device that is used for edge or back-lighting (e.g., back light poster, signage, LCD displays), bulb replacements (e.g., for replacing AC incandescent lights, low voltage lights, fluorescent lights, etc.), lights used for outdoor lighting, lights used for security lighting, lights used for exterior residential lighting (wall mounts, post/column mounts), ceiling fixtures/wall sconces, under cabinet lighting, lamps (floor and/or table and/or desk), landscape lighting, track lighting, task lighting, specialty lighting, ceiling fan lighting, archival/art display lighting, high vibration/impact lighting—work lights, etc., mirrors/vanity lighting, or any other light emitting device.

The present inventive subject matter further relates to an illuminated enclosure (the volume of which can be illuminated uniformly or non-uniformly), comprising an enclosed space and at least one lighting device according to the present inventive subject matter, wherein the lighting device illuminates at least a portion of the enclosed space (uniformly or non-uniformly).

The present inventive subject matter is further directed to an illuminated area, comprising at least one item, e.g., selected from among the group consisting of a structure, a swimming pool or spa, a room, a warehouse, an indicator, a road, a parking lot, a vehicle, signage, e.g., road signs, a billboard, a ship, a toy, a mirror, a vessel, an electronic device, a boat, an aircraft, a stadium, a computer, a remote audio device, a remote video device, a cell phone, a tree, a window, an LCD display, a cave, a tunnel, a yard, a lamppost, etc., having mounted therein or thereon at least one lighting device as described herein.

Unless otherwise defined, all terms (including technical and scientific terms) used herein have the same meaning as commonly understood by one of ordinary skill in the art to which this inventive subject matter belongs. It will be further understood that terms, such as those defined in commonly used dictionaries, should be interpreted as having a meaning that is consistent with their meaning in the context of the relevant art and the present disclosure and will not be interpreted in an idealized or overly formal sense unless expressly so defined herein.

The expression "lighting device", as used herein, is not limited, except that it is capable of emitting light. That is, a lighting device can be a device which illuminates an area or volume, e.g., a structure, a swimming pool or spa, a room, a warehouse, an indicator, a road, a parking lot, a vehicle, signage, e.g., road signs, a billboard, a ship, a toy, a mirror, a vessel, an electronic device, a boat, an aircraft, a stadium, a computer, a remote audio device, a remote video device, a cell phone, a tree, a window, an LCD display, a cave, a tunnel, a yard, a lamppost, or a device or array of devices that illuminate an enclosure, or a device that is used for edge or back-lighting (e.g., back light poster, signage, LCD displays), bulb replacements (e.g., for replacing AC incandescent lights, low voltage lights, fluorescent lights, etc.), lights used for outdoor lighting, lights used for security lighting, lights used for exterior residential lighting (wall mounts, post/column mounts), ceiling fixtures/wall sconces, under cabinet lighting, lamps (floor and/or table and/or desk), landscape lighting, track lighting, task lighting, specialty lighting, ceiling fan lighting, archival/art display lighting, high vibration/impact lighting—work lights, etc., mirrors/vanity lighting, or any other light emitting device.

The expression "annular" is used herein consistently with its conventional usage to refer to a shape which could be generated by moving a planar closed shape about a line that lies in the same plane as the shape but does not intersect the shape. That is, the expression "annular" encompasses a doughnut shape which would be generated by rotating a circle about a line that lies in the same plane as the circle, as well as shapes which would be generated by rotating a square, a triangle, an irregular (abstract) shape, etc. about a line that lies in the same plane. In addition, the expression "annular" also encompasses shapes generated by moving a circle, a square, a triangle, an irregular shape, etc. in a non-rotational manner about a line that lies in the same plane, e.g., by moving a triangle around such a line in a way such that a point on the triangle moves in a generally square pattern or a wavy pattern (or both) around the line (e.g., a "square ring").

As used herein, the term "substantially," e.g., in the expressions "substantially circular", "substantially annular", "substantially radially", "substantially diametrically", "substantially circumferentially", "substantially the same direction" and "substantially uniform cross-section", etc means at least about 95% correspondence with the feature recited, e.g., the expression "substantially circular" means that a circle can be drawn having the formula $x^2+y^2=1$, where imaginary axes can be drawn at a location where the y coordinate of each point on the structure is within 0.95 to 1.05 times the value obtained by inserting the x coordinate of such point into such formula;

the expression "substantially annular" means that at least 95% of the shape which is referred to as being substantially annular is within the bounds of a shape defined herein as being annular;

the expression "substantially radially" means that at least 95% of the points in the structure which extends "substantially radially" from an origin point define, together with the origin point, a line which defines an angle of not more than 5 degrees relative to a radial line extending through the origin point, and that the structure includes points which extend along at least 95% of the distance between the origin point and the circumference of the element relative to which the structure substantially radially extends;

the expression "substantially diametrically" means that at least 95% of the points in the structure which extends "substantially diametrically" from an origin point define, together with the origin point, a line which defines an angle of not more than 5 degrees relative to a diametrical line extending through the origin point, and that the structure includes points which extend along at least 95% of the distance along a diameter of the element relative to which the structure substantially diametrically extends;

the expression "substantially circumferentially" means that at least 95% of the points in the structure which extends "substantially circumferentially" from a center point are spaced from that center point by a distance which differs by no more than 5% from a radius, and that the structure includes points which extend around at least 95% of the circumference of a circle having such radius and such center point;

the expression "substantially the same direction" means the two or more directions which are described as being "substantially the same direction" define an angle relative to one another of not more than 9 degrees; and the expression "substantially uniform cross-sectional area" means that at least 95% of a length of the structure which is defined as having a "substantially uniform cross-sectional area" differs from a cross-sectional area quantity by not more than 5%.

The present inventive subject matter further relates to an illuminated enclosure (the volume of which can be illuminated uniformly or non-uniformly), comprising an enclosed space and at least one lighting device according to the present inventive subject matter, wherein the lighting device illuminates at least a portion of the enclosed space (uniformly or non-uniformly).

The present inventive subject matter is further directed to an illuminated area, comprising at least one item, e.g., selected from among the group consisting of a structure, a swimming pool or spa, a room, a warehouse, an indicator, a road, a parking lot, a vehicle, signage, e.g., road signs, a billboard, a ship, a toy, a mirror, a vessel, an electronic device, a boat, an aircraft, a stadium, a computer, a remote audio device, a remote video device, a cell phone, a tree, a window, an LCD display, a cave, a tunnel, a yard, a lamppost, etc., having mounted therein or thereon at least one lighting device as described herein.

Unless otherwise defined, all terms (including technical and scientific terms) used herein have the same meaning as commonly understood by one of ordinary skill in the art to which this inventive subject matter belongs. It will be further understood that terms, such as those defined in commonly used dictionaries, should be interpreted as having a meaning that is consistent with their meaning in the context of the relevant art and the present disclosure and will not be interpreted in an idealized or overly formal sense unless expressly so defined herein.

As noted above, in accordance with a first aspect of the present inventive subject matter, there is provided a lighting device which comprises a housing, at least one reflector, at least one heat transfer element and at least one light emitter.

The housing of the present inventive subject matter can be any desired housing or fixture. Skilled artisans are familiar with a wide variety of housings and fixtures, any of which can be employed in connection with the present inventive subject matter. The housing can include a heat rim as described below in connection with the third aspect of the present inventive subject matter.

For example, fixtures, other mounting structures, mounting schemes, power supplying apparatuses, housings, fixtures and complete lighting assemblies which may be used in practicing the present inventive subject matter are described in:

U.S. patent application Ser. No. 11/613,692, filed Dec. 20, 2006 (now U.S. Patent Publication No. 2007/0139923), the entirety of which is hereby incorporated by reference as if set forth in its entirety;

U.S. patent application Ser. No. 11/613,733, filed Dec. 20, 2006 (now U.S. Patent Publication No. 2007/0137074) the entirety of which is hereby incorporated by reference as if set forth in its entirety;

U.S. patent application Ser. No. 11/743,754, filed May 3, 2007 (now U.S. Patent Publication No. 2007/0263393), the entirety of which is hereby incorporated by reference as if set forth in its entirety;

U.S. patent application Ser. No. 11/755,153, filed May 30, 2007 (now U.S. Patent Publication No. 2007/0279903), the entirety of which is hereby incorporated by reference as if set forth in its entirety;

U.S. patent application Ser. No. 11/856,421, filed Sep. 17, 2007 (now U.S. Patent Publication No. 2008/0084700), the entirety of which is hereby incorporated by reference as if set forth in its entirety;

U.S. patent application Ser. No. 11/859,048, filed Sep. 21, 2007 (now U.S. Patent Publication No. 2008/0084701), the entirety of which is hereby incorporated by reference as if set forth in its entirety;

U.S. patent application Ser. No. 11/939,047, filed Nov. 13, 2007 (now U.S. Patent Publication No. 2008/0112183), the entirety of which is hereby incorporated by reference as if set forth in its entirety;

U.S. patent application Ser. No. 11/939,052, filed Nov. 13, 2007 (now U.S. Patent Publication No. 2008/0112168), the entirety of which is hereby incorporated by reference as if set forth in its entirety;

U.S. patent application Ser. No. 11/939,059, filed Nov. 13, 2007 (now U.S. Patent Publication No. 2008/0112170), the entirety of which is hereby incorporated by reference as if set forth in its entirety;

U.S. patent application Ser. No. 11/877,038, filed Oct. 23, 2007 (now U.S. Patent Publication No. 2008/0106907), the entirety of which is hereby incorporated by reference as if set forth in its entirety;

U.S. Patent Application No. 60/861,901, filed on Nov. 30, 2006, entitled "LED DOWNLIGHT WITH ACCESSORY ATTACHMENT" (inventors: Gary David Trott, Paul Kenneth Pickard and Ed Adams), the entirety of which is hereby incorporated by reference as if set forth in its entirety;

U.S. patent application Ser. No. 11/948,041, filed Nov. 30, 2007 (now U.S. Patent Publication No. 2008/0137347), the entirety of which is hereby incorporated by reference as if set forth in its entirety;

U.S. patent application Ser. No. 12/114,994, filed May 5, 2008 (now U.S. Patent Publication No. 2008/0304269), the entirety of which is hereby incorporated by reference as if set forth in its entirety;

U.S. patent application Ser. No. 12/116,341, filed May 7, 2008 (now U.S. Patent Publication No. 2008/0278952), the entirety of which is hereby incorporated by reference as if set forth in its entirety;

U.S. patent application Ser. No. 12/116,346, filed May 7, 2008 (now U.S. Patent Publication No. 2008/0278950), the entirety of which is hereby incorporated by reference as if set forth in its entirety; and U.S. patent application Ser. No. 12/116,348, filed on May 7, 2008 (now U.S. Patent Publication No. 2008/0278957), the entirety of which is hereby incorporated by reference as if set forth in its entirety.

Persons of skill in the art are familiar with a wide variety of reflectors for use in lighting devices, and any of such reflectors can be employed in the devices according to the present inventive subject matter.

The reflector (or reflectors) in a lighting device according to the present inventive subject matter can be of any desired shape, and in many embodiments, the reflector (or reflectors) is/are shaped so as to allow a high percentage of light directed toward the reflector(s) to exit from the lighting device. A wide variety of shapes for a reflector in a lighting device, or for a combination of plural reflectors in a lighting device, are well known, and any such reflectors or combinations of reflectors can be employed in the lighting devices according to the present inventive subject matter. The reflector, or the plurality of reflectors, can be shaped and oriented relative to the one or more light sources such that some or all of the light from the light source will reflect once before exiting the lighting device, will reflect twice before exiting the lighting device (i.e., once off a first reflector and once off a second reflector, or twice of the same reflector), or will reflect any other number of times before exiting the light device. This includes situations where some light from a light source reflects a first number of times (e.g., only once) before exiting the lighting device and other light from the light source reflects a second number of times (e.g., twice) before exiting the lighting device (and situations where any number of different parts of light from the light source is reflected different numbers of times).

The ability of the reflector to reflect light can be imparted in any desired way, a variety of which are well known to persons of skill in the art. For example, the reflector(s) can comprise one or more material that is reflective (and/or specular, the term "reflective" being used herein to refer to reflective and optionally also specular), and/or that can be treated (e.g., polished) so as to be reflective, or can comprise one or more material that is non-reflective or only partially reflective and which is coated with, laminated to and/or otherwise attached to a reflective material. Persons of skill in the art are familiar with a variety of materials that are reflective, e.g., metals such as aluminum or silver, a dielectric stack of materials forming a Bragg Reflector, a dichroic reflector coating on glass (e.g., as described at www.lumascape.com/pdf/literature/C1087US.pdf), any other thin film reflectors, etc. Persons of skill in the art are familiar with a wide variety of materials which are suitable for making a non-reflective or partially reflective structure which can be coated with, laminated to or otherwise attached to a reflective material, including for instance plastic materials such as polyethylene, polypropylene, natural or synthetic rubbers, polycarbonate or polycarbonate copolymer, PAR (poly(4,4'-isopropylidenediphenylene terephthalate/isophthalate) copolymer), PEI (polyetherimide), and LCP (liquid crystal polymer). The reflector(s) can be formed out of highly reflective aluminum sheet with various coatings, including silver, from companies like Alanod (http://www.alanod.de/opencms/alanod/index.html_2063069299.html.), or the reflector(s) can be formed from glass. In cases where a lighting device according to the present inventive subject matter comprises more than one reflector, the respective reflectors can be made of the same material, or any reflector (s) can be made of different materials.

Representative examples of suitable arrangements of reflectors include back-reflectors, in which an axis of light from at least one light emitter is reflected at least 90 degrees, e.g., close to or equal to 180 degrees, and forward reflectors, in which an axis of light from at least one light emitter is reflected at least 90 degrees (e.g., close to or equal to 180 degrees) a first time, and is then reflected again by at least 90 degrees (e.g., close to or equal to 180 degrees) a second time (whereby, in some cases, the axis of light is again traveling in substantially the same direction it was before being reflected for the first time).

Representative examples of suitable reflectors (and arrangements thereof) are described in many patents, e.g., U.S. Pat. Nos. 6,945,672, 7,001,047, 7,131,760, 7,214,952 and 7,246,921 (the entireties of which are hereby incorporated by reference), each of which describes, inter alia, back-reflectors.

The reflector can include cusps and/or facets, as known in the art. In some embodiments, the reflector has an M-shaped contour, as also known in the art. In some embodiments, the reflector collects the light emitted from the LEDs and reflects the light so that it does not strike the light emitter(s) and/or structure on which the light emitter(s) is/are mounted (e.g., a bridge as described in connection with embodiments discussed below), e.g., in some embodiments, the reflector is contoured and the cusps or facets are shaped such that light striking the reflector behind the bridge is directed to either side of the bridge. See, e.g., U.S. Pat. No. 7,131,760. Furthermore, in some embodiments, the reflector is contoured and the cusps or facets are shaped such that light striking the reflector not directly behind the bridge is directed to the center of the light beam's pattern and to fill in other areas of the beam that may be deficient. Each cusp or facet can be individually aimed so that light reflected from the reflector(s) forms a desired beam pattern while avoiding striking the bridge or the light emitter.

The heat transfer element(s) can comprise any heat transfer element, e.g., those described below in connection with the second aspect of the present inventive subject matter.

The light emitter (or light emitters) in the lighting devices according to the present inventive subject matter can be any desired light emitter, a variety of which are well known and readily available to persons skilled in the art. Representative examples of light emitters include incandescent lights, fluorescent lamps, LEDs (inorganic or organic, including polymer light emitting diodes (PLEDs)) with or without luminescent materials, laser diodes, thin film electroluminescent devices, light emitting polymers (LEPs), halogen lamps, high intensity discharge lamps, electron-stimulated luminescence lamps, etc.

Some embodiments of the lighting devices according to the present inventive subject matter include two or more light emitters. In such lighting devices, the respective light emitters can be similar to one another, different from one another, or any combination (i.e., there can be a plurality of light emitters of one type, or one or more light emitters of each of two or more types).

The lighting devices according to the present inventive subject matter can comprise any desired number of light emitters. For example, a lighting device according to the present inventive subject matter can include a single light emitting diode, fifty or more light emitting diodes, 1000 or more light emitting diodes, fifty or more light emitting diodes and two incandescent lights, 100 light emitting diodes and one fluorescent light, etc.

In embodiments where the light emitter(s) comprise one or more solid state light emitter, any desired solid state light emitter or emitters can be employed. Persons of skill in the art are aware of, and have ready access to, a wide variety of such emitters. Such solid state light emitters include inorganic and organic light emitters. Examples of types of such light emitters include a wide variety of light emitting diodes (inorganic or organic, including polymer light emitting diodes (PLEDs)), laser diodes, thin film electroluminescent devices, light emitting polymers (LEPs), a variety of each of which are well-known in the art (and therefore it is not necessary to describe in detail such devices, and/or the materials out of which such devices are made). Such solid state light emitters can comprise one or more luminescent materials.

Light emitting diodes are semiconducting devices that emit light (ultraviolet, visible, or infrared) when a potential difference is applied across a p-n junction structure. There are a number of well-known ways to make light emitting diodes and many associated structures, and the present inventive subject matter can employ any such devices. By way of example, Chapters 12-14 of Sze, Physics of Semiconductor Devices, (2d Ed. 1981) and Chapter 7 of Sze, Modern Semiconductor Device Physics (1998) describe a variety of photonic devices, including light emitting diodes.

The expression "light emitting diode" is used herein to refer to the basic semiconductor diode structure (i.e., the chip). The commonly recognized and commercially available "LED" that is sold (for example) in electronics stores typically represents a "packaged" device made up of a number of parts. These packaged devices typically include a semiconductor based light emitting diode such as (but not limited to) those described in U.S. Pat. Nos. 4,918,487; 5,631,190; and 5,912,477; various wire connections, and a package that encapsulates the light emitting diode. Any of such devices can be used as solid state light emitters according to the present inventive subject matter.

As is well known, a light emitting diode produces light by exciting electrons across the band gap between a conduction band and a valence band of a semiconductor active (light-emitting) layer. The electron transition generates light at a wavelength that depends on the hand gap. Thus, the color of the light (wavelength) emitted by a light emitting diode depends on the semiconductor materials of the active layers of the light emitting diode.

A wide variety of luminescent materials (also known as lumiphors or luminophoric media, e.g., as disclosed in U.S. Pat. No. 6,600,175, the entirety of which is hereby incorporated by reference) are well-known and available to persons of skill in the art. For example, a phosphor is a luminescent material that emits a responsive radiation (e.g., visible light) when excited by a source of exciting radiation. In many instances, the responsive radiation has a wavelength which is different from the wavelength of the exciting radiation. Other examples of luminescent materials include scintillators, day glow tapes and inks which glow in the visible spectrum upon illumination with ultraviolet light.

Luminescent materials can be categorized as being down-converting, i.e., a material which converts photons to a lower energy level (longer wavelength) or up-converting, i.e., a material which converts photons to a higher energy level (shorter wavelength).

Inclusion of luminescent materials in LED devices has been accomplished in a variety of ways, one representative way being by adding the luminescent materials to a clear or transparent encapsulant material (e.g., epoxy-based, silicone-based, glass-based or metal oxide-based material) as discussed above, for example by a blending or coating process.

For example, one representative example of a conventional light emitting diode lamp includes a light emitting diode chip, a bullet-shaped transparent housing to cover the light emitting diode chip, leads to supply current to the light emitting diode chip, and a cup reflector for reflecting the emission of the light emitting diode chip in a uniform direction, in which the light emitting diode chip is encapsulated with a first resin portion, which is further encapsulated with a second resin portion. The first resin portion can be obtained by filling the cup reflector with a resin material and curing it after the light emitting diode chip has been mounted onto the bottom of the cup reflector and then has had its cathode and anode electrodes electrically connected to the leads by way of wires. A luminescent material can be dispersed in the first resin portion so as to be excited with the light A that has been emitted from the light emitting diode chip, the excited luminescent material produces fluorescence ("light B") that has a longer wavelength than the light A, a portion of the light A is transmitted through the first resin portion including the luminescent material, and as a result, light C, as a mixture of the light A and light B, is used as illumination.

Representative examples of suitable solid state light emitters, including suitable light emitting diodes, luminescent materials, encapsulants, etc., are described in:

U.S. patent application Ser. No. 11/614,180, filed Dec. 21, 2006 (now U.S. Patent Publication No. 2007/0236911), the entirety of which is hereby incorporated by reference as if set forth in its entirety;

U.S. patent application Ser. No. 11/624,811, filed Jan. 19, 2007 (now U.S. Patent Publication No. 2007/0170447), the entirety of which is hereby incorporated by reference as if set forth in its entirety;

U.S. patent application Ser. No. 11/751,982, filed May 22, 2007 (now U.S. Patent Publication No. 2007/0274080), the entirety of which is hereby incorporated by reference as if set forth in its entirety;

U.S. patent application Ser. No. 11/753,103, filed May 24, 2007 (now U.S. Patent Publication No. 2007/0280624), the entirety of which is hereby incorporated by reference as if set forth in its entirety;

U.S. patent application Ser. No. 11/751,990, filed May 22, 2007 (now U.S. Patent Publication No. 2007/0274063), the entirety of which is hereby incorporated by reference as if set forth in its entirety;

U.S. patent application Ser. No. 11/736,761, filed Apr. 18, 2007 (now U.S. Patent Publication No. 2007/0278934), the entirety of which is hereby incorporated by reference as if set forth in its entirety;

U.S. patent application Ser. No. 11/936,163, filed Nov. 7, 2007 (now U.S. Patent Publication No. 2008/0106895), the entirety of which is hereby incorporated by reference as if set forth in its entirety;

U.S. patent application Ser. No. 11/843,243, filed Aug. 22, 2007 (now U.S. Patent Publication No. 2008/0084685), the entirety of which is hereby incorporated by reference as if set forth in its entirety;

U.S. patent application Ser. No. 11/870,679, filed Oct. 11, 2007 (now U.S. Patent Publication No. 2008/0089053), the entirety of which is hereby incorporated by reference as if set forth in its entirety;

U.S. patent application Ser. No. 12/117,148, filed May 8, 2008 (now U.S. Patent Publication No. 2008/0304261), the entirety of which is hereby incorporated by reference as if set forth in its entirety; and U.S. patent application Ser. No. 12/017,676, filed on Jan. 22, 2008 (now U.S. Patent Publication No. 2009/0108269), the entirety of which is hereby incorporated by reference as if set forth in its entirety.

The lighting devices according to the first aspect of the present inventive subject matter can further comprise any desired electrical connector, a wide variety of which are familiar to those of skill in the art, e.g., an Edison connector (for insertion in an Edison socket), a GU-24 connector, etc.

As noted above, in accordance with a second aspect of the present inventive subject matter, there is provided a heat transfer element which comprises a heat pipe. In this aspect of the present inventive subject matter, the heat pipe comprises a thermal transfer region and at least a first thermal exchange region. In this aspect of the present inventive subject matter, at least a portion of the first thermal exchange region extends in a shape which comprises at least a first portion of a substantially circular substantially annular shape, and at least a portion of the thermal transfer region extends in a shape which comprises at least a portion of a diameter of the substantially circular substantially annular shape.

The expression "at least portion of a diameter of the substantially circular substantially annular shape" encompasses radial structures (i.e., structures which extend from a center of a circle defined by the substantially circular substantially annular shape to the substantially circular substantially annular shape), as well as structures which extend along any portion of a diameter of such circle larger than a radius or less than a radius to the substantially circular substantially annular shape, and/or which extend along a plane which is defined by such circle or which do not extend along such a plane (or any plane), so long as it/they extends from a point on a plane which encompasses an axis of the substantially circular substantially annular shape to the substantially circular substantially annular shape.

Persons of skill in the art are familiar with heat pipes, which typically comprise a pipe made of a material which readily conducts heat (e.g., copper or aluminum). In many heat pipes, the interior of the heat pipe comprises a working fluid, e.g., water, ethanol, acetone, sodium or mercury, often under partial vacuum. The cross-sectional shape of the heat pipe can be any desired shape (which may be regular or irregular e.g., square or circular), and may vary as desired along the length of the heat pipe. In many cases, however, it is desirable for the interior of the heat pipe to be of substantially uniform cross-sectional area along its length.

In some of such embodiments, the thermal exchange region(s) extend only in one circumferential direction from the thermal transfer region. It has been observed that if thermal exchange regions extend in both circumferential directions from the thermal transfer region, heat does not travel effectively in both of such circumferential directions.

As noted above, in some embodiments of the present inventive subject matter, the portion of the first thermal exchange region extends at least 10 degrees along the first portion of the substantially circular substantially annular shape, and/or the portion of a second thermal exchange region extends at least 10 degrees along the substantially circular substantially annular shape. It has been observed that in many embodiments where one or more thermal exchange regions extend more than 70 degrees along the substantially circular substantially annular shape, most of the heat is transferred from the thermal exchange region(s) within the first 70 degrees along the substantially circular substantially annular shape.

As noted above, some embodiments of the heat transfer element according to this aspect of the present inventive subject matter further comprises a heat plate which is in thermal contact with the thermal transfer region of the heat pipe. The heat plate can be formed of any desired material, e.g., copper.

As noted above, in accordance with a third aspect of the present inventive subject matter, there is provided a heat transfer structure which comprises a heat transfer element and a heat rim.

The heat transfer structure comprises a heat pipe. The heat pipe comprises a thermal transfer region and at least a first thermal exchange region, the first thermal exchange region being in thermal contact with the heat rim. At least a portion of the heat rim is of a shape which comprises at least a portion of a substantially annular shape.

As noted above, heat pipes are well known to persons of skill in the art, and any such heat pipe can be used in accordance with this aspect of the present inventive subject matter. In some embodiments, the heat pipe can be a structure as described above in connection with the second aspect of the present inventive subject matter.

The heat rim can be made of any suitable material, a wide variety of which are known to persons skilled in the art, and any of which can be used. In some embodiments, the heat rim can be integral with, part of, or in contact with a housing of a lighting device (and such housing can any desired housing or fixture, as discussed above in connection with the first aspect of the present inventive subject matter), As noted above, in accordance with a fourth aspect of the present inventive subject matter, there is provided a lighting device, comprising a housing, a reflector disposed within the housing, a light emitter comprising an array of solid state light emitters, a heat pipe in thermal communication with the light emitter and the housing, and at least one sensor which is positioned within a region which receives direct light from the light emitter.

The housing for this aspect of the present inventive subject matter can be any desired housing or fixture, as discussed above in connection with the first aspect of the present inventive subject matter.

The reflector(s) for this aspect of the present inventive subject matter can be any desired reflector as discussed above in connection with the first aspect of the present inventive subject matter, and can be positioned and/or arranged in any way as described in connection with the first aspect of the present inventive subject matter.

The heat pipe(s) for this aspect of the present inventive subject matter can be any desired heat pipe as discussed above in connection with the second and third aspects of the present inventive subject matter, and can be positioned and/or arranged in any way as described in connection with the second and third aspects of the present inventive subject matter.

The solid state light emitters can be any desired solid state light emitters as discussed above in connection with the first aspect of the present inventive subject matter.

The array of solid state light emitters (e.g., LED chips) emit a color combination of light. In some embodiments, an array emits a white light combination or mixture of light from a plurality of LED chips. The configuration of the particular solid state light emitters in the array can contribute to the ability to mix in the near field and in particular for specular reflector systems, in the far field. Random placement of the solid state light emitters in the array can reduce natural color mixing from the solid state light emitters and may lead to color variation in the output of the lamp. To reduce or eliminate this problem, high levels of diffusion have been used, but high levels of diffusion typically result in optical losses that can reduce overall emission efficacy of the lighting device.

Different embodiments of arrays according to the fourth aspect of the present inventive subject matter can comprise different groups of LED chips emitting many different colors of light. One embodiment of an array (or LED component) according to the present inventive subject matter comprises a first group of LED chips emitting red light, and second and third groups of LED chips each comprising a blue LED covered by a conversion material (e.g., one or more luminescent material). The combination of light from the three groups of LED chips produces the desired wavelength of light and the desired color temperature, with the arrangement of the LED chips pursuant to the above guidelines promoting natural color mixing.

It is understood that arrays according to the present inventive subject matter can also be arranged other ways, and can have additional features, that promote color mixing. In some embodiments, LED chips in the array can be arranged so that they are tightly packed, which can further promote natural color mixing. The lighting devices can also comprise different diffusers and reflectors to promote color mixing in the near and far field.

Persons of skill in the art are familiar with a wide variety of sensors, and any of such sensors can be employed in the devices according to this aspect of the present inventive subject matter. Among these well known sensors are sensors which are sensitive to only a portion of visible light. For example, the sensor can be a unique and inexpensive sensor (GaP:N LED) that views the entire light flux but is only (optically) sensitive to one or more of a plurality of LEDs. For instance, in one specific example, the sensor can be sensitive to only the light emitted by LEDs which in combination produce BSY light (defined below), and the sensor can provide feedback to one or more red LEDs for color consistency as the LEDs age (and light output decreases). By using a sensor that monitors output selectively (by color), the output of one color can be selectively controlled to maintain the proper ratios of outputs and thereby maintain the color temperature of the device. This type of sensor is excited by only light having wavelengths within a particular range, e.g., a range which excludes red light (see, e.g., U.S. patent application Ser. No. 12/117,280, filed May 8, 2008 (now U.S. Patent Publication No. 2008/0309255), the entirety of which is hereby incorporated by reference as if set forth in its entirety). "BSY" light is defined in the present application (and in the applications mentioned above in this paragraph) as light having color coordinates on a 1931 CIE Chromaticity Diagram which define a point within an area enclosed by first, second, third, fourth and fifth line segments, the first line segment connecting a first point to a second point, the second line segment connecting the second point to a third point, the third line segment connecting the third point to a fourth point, the fourth line segment connecting the fourth point to a fifth point, and the fifth line segment connecting the fifth point to the first point, the first point having x, y coordinates of 0.32, 0.40, the second point having x, y coordinates of 0.36, 0.48, the third point having x, y coordinates of 0.43, 0.45, the fourth point having x, y coordinates of 0.42, 0.42, and the fifth point having x, y coordinates of 0.36, 0.38)

In many existing devices, sensors are mounted facing in the same direction that the light emitters output light. In accordance with this aspect of the present inventive subject matter, there are provided back-reflecting and forward-reflecting lamps which comprise one or more sensors which directly view the light from the light emitter(s), e.g., which face toward the light emitter(s) (in other words, in such embodiments, light travels directly from the light emitter to the sensor without being reflected or absorbed and re-emitted). As a result, the amplitude of the direct light is so great that it will swamp out any reflected or ambient light component. In some embodiments of this aspect of the present inventive subject matter, as discussed below, the sensor is recessed in the reflector (or in one of the reflectors)

to limit any variation in the amount of light sensed. In addition, in some embodiments, the sensor(s) is/are placed directly below the light emitter in the reflector, and a significant portion of the light that is output directly below the light emitter would otherwise be reflected back into the light emitter (if the sensor(s) according to the present inventive subject matter were not placed there), thereby reducing or minimizing the amount of light that is lost as a result of the placement of the sensor(s).

Other techniques for sensing changes in light output of solid state emitters include providing separate or reference emitters and a sensor that measures the light output of these emitters. These reference emitters are placed so as to be isolated from ambient light such that they typically do not contribute to the light output of the lighting device. Additional techniques for sensing the light output of a solid state lighting device include measuring ambient light and light output of the lighting device separately and then compensating the measured light output of the solid state emitters based on the measured ambient light.

In some embodiments, the sensor (or at least one of the sensors) is positioned on or within the reflector (or at least one of the reflectors) (e.g., within a bore extending into the reflector), In some embodiments, the sensor (or at least one of the sensors) is positioned within a conical region bounded by lines which each define an angle of ten degrees or less (and in some embodiments, five degrees or less) relative to an axis of direct light emitted by the light emitter (or at least one of the light emitters) when the light emitter is emitting light. In other words, in such embodiments, a line extending from the light emitter to the sensor would define an angle, relative to an axis of the light emitted by the light emitter, of not more than ten degrees (and in some embodiments, not more than five degrees).

In some embodiments, the lighting device further comprises at least one power supply, and the sensor (or at least one of the sensors) is positioned between the light emitter and the power supply. In other words, in such embodiments, a line connecting the light emitter and the power supply would pass through the sensor.

In some embodiments, the reflector (or at least one of the reflectors) comprises at least one opening, the sensor (or at least one of the sensors) being positioned opposite the opening with respect to the light emitter (or at least one of the light emitters), such that when the light emitter is emitting light, a portion of light emitted by the light emitter passes through the opening to the sensor. In such embodiments, the opening can extend completely through the reflector or only partway through the reflector.

In some embodiments, when the light emitters are emitting light, at least 90% of light emitted by the light emitters is reflected only once by the reflector (or at least one of a plurality of reflectors). Representative examples of such embodiments include lamps with back-reflectors (i.e., "back-reflecting lamps"), as discussed above.

In some embodiments, when the light emitters are emitting light, at least 10% of light emitted by the light emitters is reflected at least twice by the reflector (or one of the reflectors). A representative example of such an embodiment includes a back-reflecting lamp with a reflector which has plural regions, in which some of the light from the light emitter is reflected once, while other portions of the light from the light emitters are reflected plural times, and some or all of the reflected light exits the lighting device in a direction which differs by greater than 90 degrees, e.g., close to or equal to 180 degrees, from the direction in which it is emitted from a light emitter.

In some embodiments, the lighting device comprises a plurality of reflectors, and when the light emitters are emitting light, at least 10% of light emitted by the light emitters is reflected by at least two of the plurality of reflectors. A representative example of such an embodiment includes a back-reflecting lamp with plural reflectors, in which some of the light from the light emitters is reflected by one of the reflectors, while other portions of the light from the light emitters are reflected by more than one of the reflectors, and some or all of the reflected light exits the lighting device in a direction which differs by greater than 90 degrees, e.g., close to or equal to 180 degrees, from the direction in which it is emitted from a light emitter.

In some embodiments, the light emitter comprises a plurality of reflectors, and when the light emitters are emitting light, at least 70% of light emitted by the light emitters is reflected by at least two of the plurality of reflectors. A representative example of such an embodiment includes a forward-reflecting lamp, in which an axis of light from at least one light emitter is reflected at least 90 degrees (e.g., close to or equal to 180 degrees) by a first reflector (or plurality of reflectors), and is then reflected again by at least 90 degrees (e.g., close to or equal to 180 degrees) a second time (whereby, in some cases, the axis of light is again traveling in substantially the same direction it was before being reflected for the first time) by a second reflector (or plurality of reflectors).

The lighting devices of the present inventive subject matter can be supplied with electricity in any desired manner. Skilled artisans are familiar with a wide variety of power supplying apparatuses, and any such apparatuses can be employed in connection with the present inventive subject matter. The lighting devices of the present inventive subject matter can be electrically connected (or selectively connected) to any desired power source, persons of skill in the art being familiar with a variety of such power sources.

Representative examples of apparatuses for supplying electricity to lighting devices and power supplies for lighting devices, all of which are suitable for the lighting devices of the present inventive subject matter, are described in:

U.S. patent application Ser. No. 11/626,483, filed Jan. 24, 2007 (now U.S. Patent Publication No. 2007/0171145), the entirety of which is hereby incorporated by reference as if set forth in its entirety;

U.S. patent application Ser. No. 11/755,162, filed May 30, 2007 (now U.S. Patent Publication No. 2007/0279440), the entirety of which is hereby incorporated by reference as if set forth in its entirety;

U.S. patent application Ser. No. 11/854,744, filed Sep. 13, 2007 (now U.S. Patent Publication No. 2008/0088248), the entirety of which is hereby incorporated by reference as if set forth in its entirety;

U.S. patent application Ser. No. 12/117,280, filed May 8, 2008 (now U.S. Patent Publication No. 2008/0309255), the entirety of which is hereby incorporated by reference as if set forth in its entirety; and U.S. patent application Ser. No. 12/328,144, filed Dec. 4, 2008 (now U.S. Patent Publication No. 2009/0184666), the entirety of which is hereby incorporated by reference as if set forth in its entirety.

The lighting devices according to the present inventive subject matter can further comprise any desired electrical connector, a wide variety of which are familiar to those of skill in the art, e.g., an Edison connector (for insertion in an Edison socket), a GU-24 connector, etc.

In some embodiments according to the present inventive subject matter, the lighting device is a self-ballasted device. For example, in some embodiments, the lighting device can be directly connected to AC current (e.g., by being plugged into a wall receptacle, by being screwed into an Edison socket, by being hard-wired into a circuit, etc.). Representative examples of self-ballasted devices are described in U.S. patent application Ser. No. 11/947,392, filed on Nov. 29, 2007 (now U.S. Patent Publication No. 2008/0130298), the entirety of which is hereby incorporated by reference as if set forth in its entirety).

In addition, one or more scattering elements (e.g., layers) can optionally be included in the lighting devices according to this aspect of the present inventive subject matter. The scattering element can be included in a lumiphor, and/or a separate scattering element can be provided. A wide variety of separate scattering elements and combined luminescent and scattering elements are well known to those of skill in the art, and any such elements can be employed in the lighting devices of the present inventive subject matter.

The devices according to the present inventive subject matter can further comprise secondary optics to further change the projected nature of the emitted light. Such secondary optics are well known to those skilled in the art, and so they do not need to be described in detail herein—any such secondary optics can, if desired, be employed.

Embodiments in accordance with the present inventive subject matter are described herein with reference to cross-sectional (and/or plan view) illustrations that are schematic illustrations of idealized embodiments of the present inventive subject matter. As such, variations from the shapes of the illustrations as a result, for example, of manufacturing techniques and/or tolerances, are to be expected. Thus, embodiments of the present inventive subject matter should not be construed as limited to the particular shapes of regions illustrated herein but are to include deviations in shapes that result, for example, from manufacturing. For example, a molded region illustrated or described as a rectangle will, typically, have rounded or curved features. Thus, the regions illustrated in the figures are schematic in nature and their shapes are not intended to illustrate the precise shape of a region of a device and are not intended to limit the scope of the present inventive subject matter.

Figure 2:
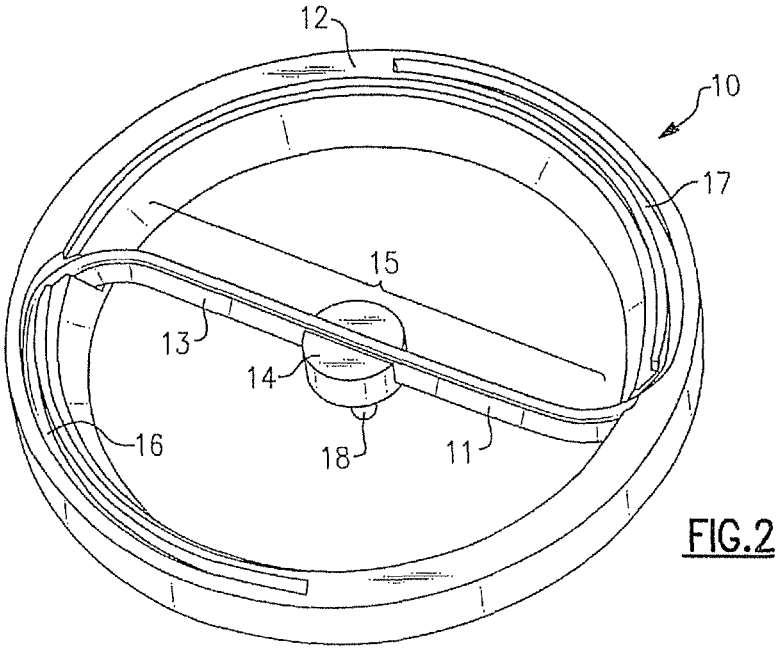
FIG. 2 is a perspective view of the first embodiment of a heat transfer structure according to the present inventive subject matter.

FIGS. 1-2 depict a first embodiment of a heat transfer structure according to the present inventive subject matter. Referring to FIGS. 1 and 2, the heat transfer structure 10 comprises a heat transfer element 11 and a heat rim 12.

The heat transfer element 11 comprises a heat pipe 13 and a heat plate 14. The heat pipe 13 comprises a thermal transfer region 15, a first thermal exchange region 16 and a second thermal exchange region 17. The first and second thermal exchange regions 16 and 17 are each in thermal contact with the heat rim 12, each being snugly fitted in respective grooves in the heat rim, such that each thermal exchange region is in contact with the heat rim 12 on a front side, a rear side and a bottom side of the thermal exchange region.

The heat rim 12 is substantially annular, i.e., it is of a shape which comprises at least a portion (namely, the entirety) of a substantially annular shape, and the annular shape is substantially circular.

At least a portion of the first thermal exchange region 16 (namely, its entirety) extends substantially circumferentially along a first portion of the substantially circular substantially annular shape, i.e., the heat rim 12, and the first thermal exchange region 16 extends for about 70 degrees around the circumference of the heat rim 12. Likewise, at least a portion of the second thermal exchange region 17 (namely, its entirety) extends substantially circumferentially along a second portion of the heat rim 12, for about 70 degrees around the circumference of the heat rim 12. The first and second thermal transfer exchange regions 16 and 17 each extend in the same circumferential direction relative to the thermal transfer region, i.e., counter-clockwise.

The heat plate 14 is in thermal contact with the thermal transfer region 15 of the heat pipe 13. The heat plate 14 comprises a heat plate groove, and a portion of the thermal transfer region 15 extends along the heat plate groove.

Referring to FIG. 2, a light emitter 18 is mounted on the heat plate 14.

Figure 3:
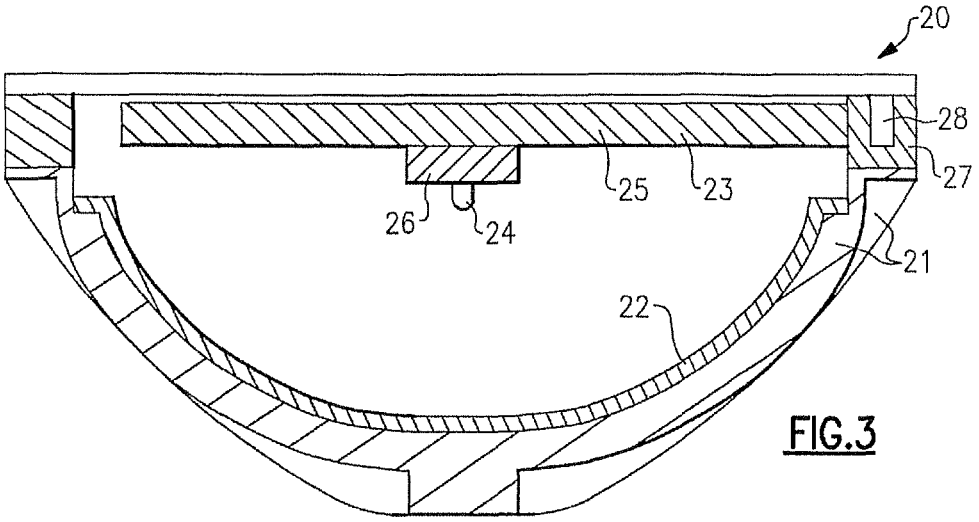
FIG. 3 is a sectional view of the first embodiment of a lighting device according to the present inventive subject matter.

FIG. 3 depicts a first embodiment of a lighting device according to the present inventive subject matter. Referring to FIG. 3, the lighting device 20 comprises a housing 21, a reflector 22, a heat transfer element 23 and a light emitter 24. The heat transfer element 23 comprises a heat pipe 25 and a heat plate 26. The light emitter 24 is mounted on the heat transfer element 23, namely, on the heat plate 26. The housing comprises a heat rim 27, and the heat transfer element 23 is in thermal contact with a portion of the housing 21, namely, the heat rim 27. The heat rim 27 and the heat transfer element 23 shown in FIG. 3 correspond to those elements shown in the embodiment depicted in FIGS. 1 and 2, the section of those elements in FIG. 3 corresponding to a section of those elements in FIG. 1 along the line III-III. One of the heat rim grooves 28 is visible in FIG. 3. The embodiment depicted in FIG. 3 further comprises a glass cover 30.

Figure 4:
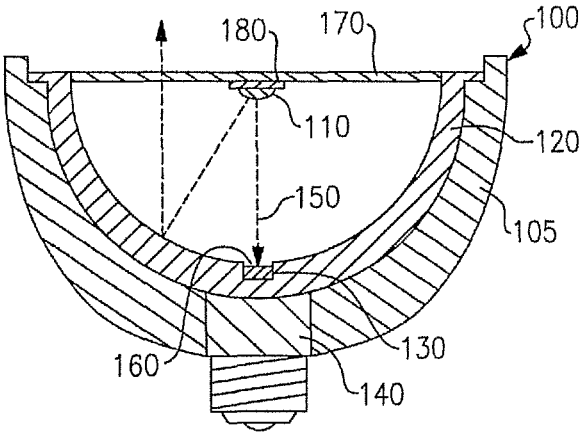
FIG. 4 is a cross-sectional view of a second embodiment of a lighting device according to the present inventive subject matter.
Figure 5:
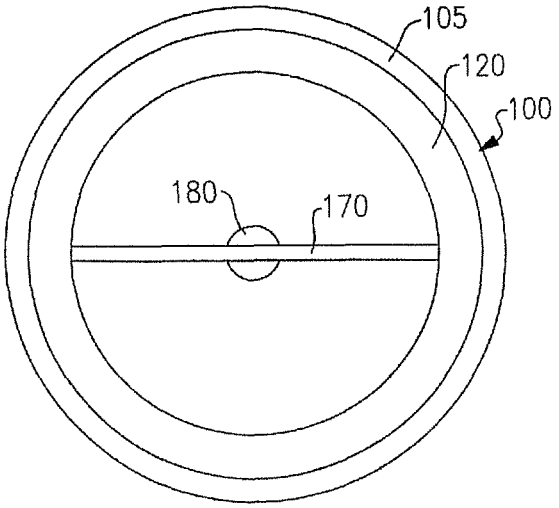
FIG. 5 is a top view of the lighting device depicted in FIG. 4.
Figure 6:
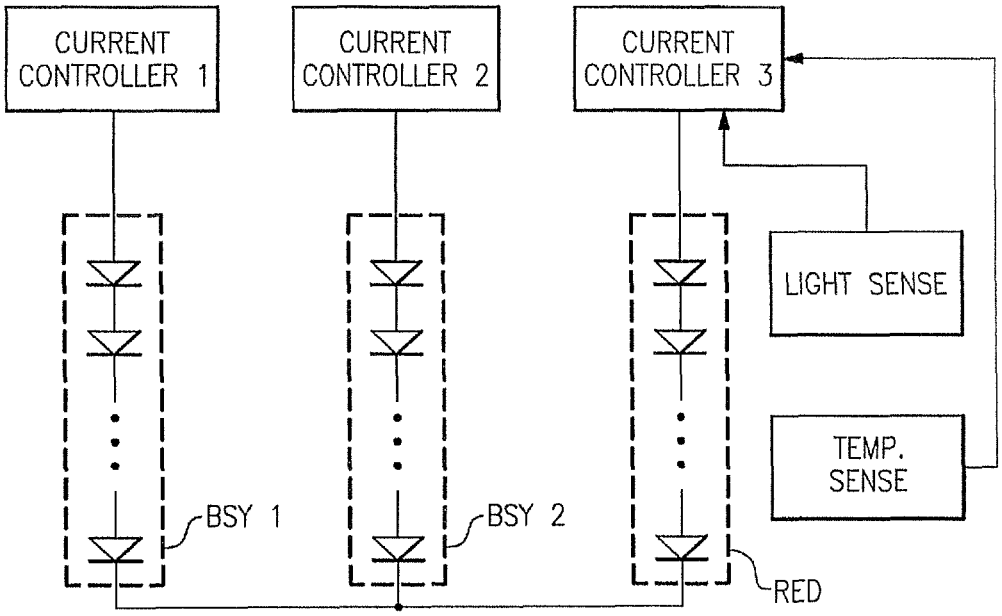
FIG. 6 illustrates a circuit utilizing a light sensor according to the present inventive subject matter.

FIGS. 4 through 6 illustrate further aspects of embodiments of a self ballasted lamp according to the present inventive subject matter. Referring to FIG. 4, the self ballasted lamp 100 comprises a housing 105, a solid state light source 110, a reflector 120, an optional sensor 130 and a power supply 140. The optional sensor 130 may be positioned within a region which receives direct light from the light source 110 when the light source 110 is emitting light.

In this embodiment, the light source 110 comprises a plurality of solid state light emitters, including a plurality of LEDs which each comprise a light emitting diode which emits blue light and luminescent material which absorbs a portion of the blue light and emits greenish-yellow light and a plurality of LEDs which emit red light and/or red-orange light. Thus, some of the LEDs may include LEDs that emit non-white, non-saturated light. Optionally, a light emitting diode(s) that emits blue or cyan light without a corresponding luminescent material may also be provided. See, e.g. U.S. patent application Ser. No. 12/248,220, filed on Oct. 9, 2008 (now U.S. Patent Publication No. 2009/0184616). In particular embodiments, the light source 110 may be provided as an array of strings of light emitting diodes with a lens as described above. Additionally, a diffuser may also be provided on, in or near the light emitting diodes as described in U.S. Provisional Patent Application No. 60/130,411, entitled "Light Source With Near Field Mixing," the entirety of which is incorporated herein by reference as if set forth in its entirety. Thus, the self ballasted lamp 100 may be configured such that light exiting the lamp 100 is perceived as white in the near field.

In some embodiments, the light source 110 emits light having a Correlated Color Temperature (CCT) of not greater than about 4000K. For example, in some embodiments, the CCT is about 4000K, in others about 3500K and in still others, about 2700K. In some embodiments, the light source emits light having a Color Rendering Index (Ra) of at least about 90.

The sensor 130 may be positioned within the reflector 120, within a conical region bounded by lines which each define an angle of about five degrees relative to the axis 150 of direct light emitted by the light source 110 when the light source 110 is emitting light. The sensor 130 is also positioned between the light source 110 and the power supply 140.

The reflector 120 comprises an opening 160, and the sensor 130 is positioned opposite the opening 160 with respect to the light source 110, such that when the light source 110 is emitting light, a portion of light emitted by the light source 110 passes through the opening 160 to the sensor 130.

The upper edge of the reflector 120 is generally circular, and the reflector 120 is generally parabolic. In alternative embodiments, the upper edge of the reflector can take other shapes, such as square, rectangular or other configurations, and the overall shape of the reflector 120 can be of any desired configuration.

In some embodiments, the aperture of the reflector 120 from which light exits is 4 inches (10.2 cm) or less. By providing a reflector with an aperture of 4 inches or less, the self ballasted lamp may be configured to have external dimensions of a PAR-38 lamp. In other embodiments, the lamp is configured to have external dimensions of a PAR-30 lamp. The dimensions of PAR-38 and PAR-30 lamps are described in ANSI Standard C78.21-2003 entitled "PAR and R Shapes," the disclosure of which is incorporated herein as if set forth in its entirety.

In some embodiments, the reflector 120 reflects light to provide a beam angle of 30 degrees or less. In other embodiments, the reflector 120 provides a beam angle of 20 degrees or less, and in still further embodiments, the reflector 120 provides a beam angle of 10 degrees or less. As used herein, the term "beam angle" refers to the angle of the full width half max of the light exiting the reflector.

In particular embodiments, the sensor is sensitive to only some wavelengths of visible light, including the wavelengths of light emitted by the light emitting diodes which emit blue light and the luminescent material, but not the light emitting diodes which emit red light.

Referring to FIG. 5, the self ballasted lamp 100 further includes a bridge 170 and a circuit board 180. The bridge 170 spans an opening defined by the upper edge of the reflector 120. The bridge 170 and the reflector 120 can be made from one piece, or the bridge 170 can be a separate piece that is attached to the reflector 120. In this embodiment, the bridge 170 substantially bisects the opening defined by the upper edge of the reflector 120. In some embodiments, the width of the bridge 170 is minimized in order to minimize the amount of light that contacts the bridge 170 and/or needs to be directed around the bridge 170. The bridge 170 is depicted as spanning the opening defined by the upper edge of the reflector 120, but it can instead cantilever over the opening. Alternatively, the bridge 170 could be eliminated entirely and the light source held in place by a transparent cover or lens over the reflector 120 with conductive traces or other wiring to the light source.

The bridge 170 may include or be provided by an "S" shaped heat pipe as described above. Furthermore, the bridge 170, and any associated heat transfer component(s), may be thermally coupled to the housing 105 to provide a thermal management system. In particular, the thermal management system may be provided by one or more of the "S" shaped heat pipes, a heat plate and/or a heat rim as described above. Additionally, further heat dissipation may be provided by a heat sink thermally coupled to the heat rim, a transparent heat sink and/or the housing.

As understood by those of skill in the art, in many solid state lighting systems, the lifetime of the solid state light emitters can be correlated to a junction temperature of the solid state light emitters. The correlation between lifetime and junction temperature may differ based on the manufacturer of the solid state light emitter (e.g., Cree, Inc., Philips-Lumileds, Nichia, etc). The lifetimes are typically rated as thousands of hours at a particular junction temperature. Thus, in particular embodiments, the thermal management system of the self ballasted lamp 100 is configured to extract heat from the solid state light source 110 and transfer the extracted heat to a surrounding environment and maintain a junction temperature of the solid state light source 110 at or below a 25,000 hour rated lifetime junction temperature for the solid state light source in a 25° C. surrounding environment. In some embodiments, the thermal management system maintains the junction temperature of the solid state light source 110 at or below a 35,000 hour rated lifetime junction temperature. In further embodiments, the thermal management system maintains the junction temperature of the solid state light source 110 below a 50,000 hour rated lifetime junction temperature. In still other embodiments, the thermal management system maintains the junction temperature of the solid state light source 110 below a 50,000 hour rated lifetime junction temperature in a 35° C. surrounding environment.

The light emitter(s) of the light source 110 may be mounted on the circuit board 180, and the circuit board 180 may be attached to the bridge 170 on a surface substantially facing the reflector 120. Other arrangements for mounting the light emitter to the bridge may also be used. For example, the light emitter may be mounted directly to the bridge or to a separate central mounting plate attached to the bridge, such as the heat plate described above. Furthermore, the circuit board 180 may be provided, for example, as a ceramic or other substrate for the packaged array of strings of light emitting diodes.

Optionally, the self ballasted lamp 100 can further include a circular lens which covers over the reflector 120 (i.e., which would cover the view shown in FIG. 5). Persons of skill in the art are familiar with a wide variety of lenses which would be suitable for use in the lighting devices according to the present inventive subject matter, and any of such lens covers can be used. Such lenses can be clear or colored, and can, if desired, include optical features. Alternatively, the lens may be provided as part of a thermal management system. In particular, the lens may be provided as a transparent heat sink as described in U.S. Patent Application No. 61/108,130, filed on Oct. 24, 2008, entitled "LIGHTING DEVICE WHICH INCLUDES ONE OR MORE SOLID STATE LIGHT EMITTING DEVICE" (inventors: Antony Paul van de Ven and Gerald H. Negley), the entirety of which is hereby incorporated by reference as if set forth in its entirety.

FIG. 6 illustrates a circuit that may be provided as the power supply 140 utilizing the optional light sensor. The circuit shown in FIG. 6 also includes a temperature sensor. The circuit shown in FIG. 6 further includes three current controllers, a first to control current supplied to a first string of BSY LEDs, a second to control current supplied to a second string of BSY LEDs, and a third to control current supplied to a string of red LEDs (i.e., LEDs which emit red light). FIG. 6 illustrates three strings of LEDs, but any number of strings of LEDs may be utilized, as desired. The outputs from the temperature sensor and the light sensor affect the current supplied to the red LEDs. Additional details regarding the circuit depicted in FIG. 6 are described in U.S. patent application Ser. No. 12/117,280, filed May 8, 2008 (now U.S. Patent Publication No. 2008/0309255), the entirety of which is hereby incorporated by reference as if set forth in its entirety.

The self ballasted lamp 100 as described herein may provide a wall plug efficiency of at least about 40 delivered lumens per watt, in some embodiments at least about 50 lumens per watt and in still further embodiments, at least about 60 lumens per watt. As used herein, the term "delivered lumens" refers to the lumen output that exits the self ballasted lamp 100. Additionally, wall plug efficiency refers to the delivered lumens divided by the input power to the self ballasted lamp.

The present inventive subject matter further comprises embodiments as depicted in FIGS. 4 and 5, wherein the light source 110 comprises an LED component 240 as shown in FIGS. 7*a*-7*e*. Referring to FIGS. 7*a*-7*e*, there is shown an LED component 240 comprising a submount 242 for holding an array of LED chips, with the submount 242 having die pads 244 and conductive traces 246 on its top surface. LED chips 248 are included that comprise the LED array, with each of the LED chips 248 mounted to a respective one of the die pads 244. The LEDs chips 248 can have many different semiconductor layers arranged in different ways and can emit many different colors in different embodiments according to the present inventive subject matter. LED structures, features, and their fabrication and operation are generally known in the art and only briefly discussed herein.

The layers of the LEDs chips 248 can be fabricated using known processes with a suitable process being fabrication using metal organic chemical vapor deposition (MOCVD). The layers of the LED chips generally comprise an active layer/region sandwiched between first and second oppositely doped epitaxial layers all of which are formed successively on a growth substrate. LED chips can be formed on a wafer and then singulated for mounting in a package. It is understood that the growth substrate can remain as part of the final singulated LED or the growth substrate can be fully or partially removed.

It is also understood that additional layers and elements can also be included in the LED chips 248, including but not limited to buffer, nucleation, contact and current spreading layers as well as light extraction layers and elements. The active region can comprise single quantum well (SQW), multiple quantum well (MQW), double heterostructure or super lattice structures. The active region and doped layers may be fabricated from different material systems, with preferred material systems being Group-Ill nitride based material systems. Group-Ill nitrides refer to those semiconductor compounds formed between nitrogen and the elements in the Group III of the periodic table, usually aluminum (Al), gallium (Ga), and indium (In). The term also refers to ternary and quaternary compounds such as aluminum gallium nitride (AlGaN) and aluminum indium gallium nitride (AlInGaN). In a preferred embodiment, the doped layers are gallium nitride (GaN) and the active region is InGaN. In alternative embodiments, the doped layers may be AlGaN, aluminum gallium arsenide (AlGaAs), aluminum gallium indium arsenide phosphide (AlGaInAsP), aluminum indium gallium phosphide (AlInGaP) or zinc oxide (ZnO).

The growth substrate can be made of any of many materials (or combinations thereof), such as silicon, glass, sapphire, silicon carbide, aluminum nitride (AlN), gallium nitride (GaN), with a suitable substrate being a 4H polytype of silicon carbide, although other silicon carbide polytypes can also be used including 3C, 6H and 15R polytypes. Silicon carbide has certain advantages, such as a closer crystal lattice match to Group III nitrides than sapphire and results in Group III nitride films of higher quality. Silicon carbide also has a very high thermal conductivity so that the total output power of Group-III nitride devices on silicon carbide is not limited by the thermal dissipation of the substrate (as may be the case with some devices formed on sapphire). SiC substrates are available from Cree Research, Inc., of Durham, N.C. and methods for producing them are set forth in the scientific literature as well as in U.S. Pat. Nos. Re. 34,861; 4,946,547; and 5,200,022.

The LED chips 248 can also comprise a conductive current spreading structure and wire bond pads on the top surface, both of which are made of a conductive material, and can be deposited using known methods. Some materials that can be used for these elements include Au, Cu, Ni, In, Al, Ag or combinations thereof and conducting oxides and transparent conducting oxides. The current spreading structure can comprise conductive fingers arranged in a grid on the LED chips 248 with the fingers spaced to enhance current spreading from the pads into the LED's top surface. In operation, an electrical signal is applied to the pads through a wire bond as described below, and the electrical signal spreads through the fingers of the current spreading structure and the top surface into the LED chips 248. Current spreading structures are often used in LEDs where the top surface is p-type, but can also be used for n-type materials.

Some or all of the LED chips 248 can be coated with one or more phosphors, with the phosphors absorbing at least some of the LED light and emitting a different wavelength of light such that the LED emits a combination of light from the LED and the phosphor. As described in detail below, in one embodiment according to the present inventive subject matter, at least some of the LED chips can comprise an LED that emits light in the blue wavelength spectrum with its phosphor absorbing some of the blue light and re-emitting yellow light. These LED chips 248 emit a white light combination of blue and yellow light, or a non-white light combination of blue and yellow light. As used herein, the term "white light" refers to light that is perceived as white and is within 7 MacAdam ellipses of the blackbody locus on a 1931 CIE chromaticity diagram, and has a CCT in the range of from 2000 K to 10,000 K. In one embodiment, the phosphor comprises commercially available YAG:Ce, although a full range of broad yellow spectral emission is possible using conversion particles made of phosphors based on the $(Gd,Y)_3(Al,Ga)_5O_{12}$:Ce system, such as the $Y_3Al_5O_{12}$:Ce (YAG). Other yellow phosphors that can be used for white emitting LED chips include:

$Tb_{3-x}RE_xO_{12}$:Ce(TAG); RE=Y, Gd, La, Lu; or $Sr_{2-x-y}Ba_xCa_ySiO_4$:Eu.

In some embodiments, others of LED chips can comprise blue emitting LED coated by other phosphors that absorb blue light and emit yellow or green light. Some of the phosphors that can be used for these LED chips include:

Yellow/Green $(Sr,Ca,Ba)(Al,Ga)_2S_4:Eu^{2+}$ $Ba_2(Mg,Zn)Si_2O_7:Eu^{2+}$ $Gd_{0.46}Sr_{0.31}Al_{1.23}O_xF_{1.38}:Eu^{2+0.06}$ $(Ba_{1-x-y}Sr_xCa_y)SiO_4$:Eu $Ba_2SiO_4:Eu^{2+}$ The LED chips 248 emitting red light can comprise LED structures and materials that permit emission of red light directly from the active region. Alternatively, in other embodiments, the red emitting LED chips 248 can comprise LEDs covered by a phosphor that absorbs the LED light and emits a red light. Some phosphors appropriate for this structures can comprise:

Red $Lu_2O_3:Eu^{3+}$ $(Sr_{2-x}La_x)(Ce_{1-x}Eu_x)O_4$ $Sr_2Ce_{1-x}Eu_xO_4$ $Sr_{2-x}Eu_xCeO_4$ $SrTiO_3:Pr^{3+}Ga^{3+}$ $CaAlSiN_3:Eu^{2+}$ $Sr_2Si_5N_8:Eu^{2+}$

Each of the phosphors described above exhibits excitation in the desired emission spectrum, provides a desirable peak emission, has efficient light conversion, and has acceptable Stokes shift. It is understood, however, that many other phosphors can used in combination with other LED colors to achieve the desired color of light.

The LED chips 248 can be coated with a phosphor using many different methods, with one suitable method being described in U.S. patent application Ser. Nos. 11/656,759 (now U.S. Patent Publication No. 2008-0173884) and Ser. No. 11/899,790 (now U.S. Patent Publication No. 2008-0179611), both entitled "Wafer Level Phosphor Coating Method and Devices Fabricated Utilizing Method", and both of which are incorporated herein by reference. Alternatively the LEDs can be coated using other methods such as electrophoretic deposition (EPD), with a suitable EPD method described in U.S. patent application Ser. No. 11/473,089 (now U.S. Patent Publication No. 2007-0158668) entitled "Close Loop Electrophoretic Deposition of Semiconductor Devices", which is also incorporated herein by reference. It is understood that LED packages according to the present inventive subject matter can also have multiple LEDs of different colors, one or more of which may be white emitting.

The submount 242 can be formed of any of many different materials, with a preferred material being electrically insulating, such as a dielectric. The submount 242 can comprise ceramic such as alumina, aluminum nitride, silicon carbide, or a polymeric material such as polyimide and polyester etc. In a preferred embodiment, the submount material has a high thermal conductivity such as with aluminum nitride and silicon carbide. In other embodiments, the submount 242 can comprise highly reflective material, such as reflective ceramic or metal layers like silver, to enhance light extraction from the component. In other embodiments, the submount 242 can comprise a printed circuit board (PCB), sapphire, silicon carbide or silicon or any other suitable material, such as T-Clad thermal clad insulated substrate material, available from The Bergquist Company of Chanhassen, Minn. For PCB embodiments, different PCB types can be used such as standard FR-4 PCB, metal core PCB, or any other type of printed circuit board. The size of the submount 242 can be selected depending on different factors, with one being the size and number of LED chips 248.

The die pads 244 and conductive traces 246 can comprise any of many different materials such as metals or other conductive materials. In one embodiment, they can comprise copper deposited using known techniques such as plating and can then be patterned using standard lithographic processes. In other embodiments, the layer can be sputtered using a mask to form the desired pattern. In some embodiments according to the present inventive subject matter, some of the conductive features can include only copper, with others of the features including additional materials. For example, the die pads 244 can be plated or coated with additional metals or materials to make them more suitable for the mounting of LEDs. In one embodiment, the die pads 244 can be plated with adhesive or bonding materials, or reflective and barrier layers. The LEDs can be mounted to the die pads 244 using known methods and materials such as using conventional solder materials that may or may not contain a flux material or dispensed polymeric materials that may be thermally and electrically conductive.

In the embodiment shown, wire bonds can be included that pass between the conductive traces 246 and each of the LED chips 248 with an electrical signal applied to each of the LED chips 248 through its respective one of the die pads 244 and the wire bonds. In other embodiments, LED chips 248 may comprise coplanar electrical contacts on one side of the LED (bottom side) with the majority of the light emitting surface being located on the LED side opposing the electrical contacts (upper side). Such flip-chip LEDs can be mounted onto the submount 242 by mounting contacts corresponding to one electrode (anode or cathode, respectively) onto the die pad 244. The contacts of the other LED electrode (cathode or anode, respectively) can be mounted to the traces 246.

An optical element/lens 255 is included over the LED chips 248 to provide both environmental and mechanical protection. The lens 255 can be in different locations on the top surface of the submount 242 with the lens typically located at approximately the center of the top surface of the submount 242. In the embodiment shown, the lens is slightly off center of the submount 242 to provide spacing on the submount's top surface for the contact pads that are described in detail below. In some embodiments, the lens 255 can be formed in direct contact with the LED chips 248 and the top surface of the submount 242 around the LED chips. In other embodiments, there may be an intervening material or layer between the LED chips 248 and the submount's top surface. Direct contact to the LED chips 248 can provide certain advantages, such as improved light extraction and ease of fabricating.

As further described below, the lens 255 can be formed over the LED chips 248 using different molding techniques and the lens can be many different shapes depending on the desired shape of the light output. One suitable shape as shown is hemispheric, with some examples of alternative shapes being ellipsoid bullet, flat, hex-shaped and square. Many different materials can be used for the lens such as silicones, plastics, epoxies or glass, with a suitable material being compatible with molding processes. Silicone is suitable for molding and provides suitable optical transmission properties. It can also withstand subsequent reflow processes and does not significantly degrade over time. It is understood that the lens 255 can also be textured to improve light extraction or can contain materials such as phosphors or scattering particles.

For hemispheric embodiments, any of many different lens sizes can be used, with typical hemispheric lenses being greater than 5 mm in diameter, with one embodiment being greater than approximately 11 mm. The preferred LED array size to lens diameter ratio should be less than approximately 0.6, and preferably less than 0.4. For such hemispheric lenses, the focal point of the lens shall be essentially at the same horizontal plane as the emission region of the LED chips.

In yet other embodiments, the lens 255 can have a large diameter of about the same or larger than the distance across or width of the LED array. For circular LED arrays, the diameter of the lens can be approximately the same as or larger than the diameter of the LED array. The focal point for such lenses is preferably below the horizontal plane created by the emitting region of the LED chips. The advantage of such lenses is the ability to spread the light over larger solid emission angles, and therefore allow for a broader illuminated area.

The LED package 240 can also comprise a protective layer 256 covering the top surface of the submount 242 in those areas not covered by the lens 255. The layer 256 provides additional protection to the elements on the top surface to reduce damage and contamination during subsequent processing steps and use. Protective layer 256 can be formed during formation of the lens 255 and can comprise the same material as the lens 255. It is understood, however, that the LED package 240 can also be provided without the protective layer 256.

The lens arrangement of the LED package 240 is also easily adapted for use with secondary lens or optics that can be included over the lens by the end user to facilitate beam shaping. These secondary lenses are generally known in the art, with many different ones being commercially available. The lens 255 can also have different features to diffuse or scatter light, such as scattering particles or structures. Particles made from different materials can be used such as titanium dioxide, alumina, silicon carbide, gallium nitride, or glass micro spheres, with the particles dispersed within the lens. Alternatively, or in combination with the scattering particles, air bubbles or an immiscible mixture of polymers having a different index of refraction could be provided within the lens or structured on the lens to provide diffusion. The scattering particles or structures can be dispersed homogeneously throughout the lens 255 or can have different concentrations in different areas of the lens. In one embodiment, the scattering particles can be in layers within the lens, or can have different concentrations in relation to the location of the LED chips 248 emitting different colors of in the array.

Referring now to FIG. 8, the LED chips 248 can comprise different groups of LEDs chips that emit different colors of light. These different groups should complement one another by combining so that the LED component produces the desired color of light along with the desired color rendering index (CRI). In one embodiment, the LED chips 248 can comprise groups emitting two or more different colors, with a suitable number of groups being three. Three different color groups allows for colors to be selected to triangulate into the desired color point, with one such desired color point being on or near the black body locus (BBL) on a CIE Chromaticity Diagram for the desired color temperature. The three different groups can emit different color around the BBL such that when they combine, the color emitted by the LED component is on or near the BBL.

In the embodiment shown, the LED chips 248 can comprise groups of red emitting LEDs 255 (designated with R), a first group of phosphor coated blue LEDs 252 (designated with B), and a second group of phosphor coated blue LEDs 250 (designated with C). The first and second groups of phosphor coated LEDs 252, 254 can comprise blue LEDs coated with a yellow or green emitting phosphor to provide non-white light sources, e.g., as described in U.S. Pat. No. 7,213,940 and below. LED chips having LEDs that emit light having a dominant wavelength in the range of from 430 nm to 480 nm and a phosphor which, when excited, emits light having a dominant wavelength in the range from 555 nm to 585 nm are suitable for use as the solid state light emitters in the first and second groups of LEDs 250, 252. These first and second LED groups 250, 252 can emit different color combinations of blue LED light and phosphor light such that the LED chip groups emit respective colors of light. This allows the emission of the LEDs to combine with the emission of the red LEDs 254 to triangulate to the desired white light emission for the LED component 240. In one embodiment, the combined light for the LED chips is on or near the BBL for a desired color point (e.g., correlated color temperature (CCT)), while also providing a high CRI. In particular embodiments, the combined light is perceived as white light (i.e. is within 7 MacAdam ellipses of the BBL).

By dividing the LED chips 248 into three or more groups 250, 252, 253 the LED component 240 can also be arranged to apply respective electrical signals through each of the groups, with each of the signals capable of being adjusted in order to tune the LED component 240 to emit light which more closely approximates the target color coordinates (i.e., even where the individual light emitters, e.g., solid state light emitters, deviate to some degree from their design output light color coordinates and/or lumen intensity). The details for establishing the appropriate current to apply to each of the groups is described in detail U.S. Provisional Patent Application Ser. No. 61/041,404 entitled "Solid State Lighting Devices and Methods of Manufacturing Same," the entirety of which is incorporated herein by reference.

In one embodiment according to the present inventive subject matter, an LED component 240 is provided that emits white light and, in particular, white light near the black body curve and having color temperature of 2700K or 3500K. The LED component includes three groups of LED chips as described above, with first and second groups comprising LEDs which emit BSY light, and another group comprising LEDs which emit red light. The two groups of BSY LEDs 250, 252 are of intentionally different BSY hues, so that the relative intensities of those groups may be adjusted to move along the tie line between the respective color coordinates (on a CIE Diagram) for the two strings. By providing a red group, the intensity of the LED chips in the red group can be adjusted to tune the light output from the lighting device such as to the BBL or to within a desired minimum distance from the BBL (e.g., within 7 MacAdam ellipses).

In one embodiment according to the present inventive subject matter:

(1) the first group of LED chips 250 comprises at least one LED chip where if power is supplied to the first group it emits light having x, y color coordinates which define a point which is within an area on a 1931 CIE Chromaticity Diagram enclosed by first, second, third, fourth and fifth line segments, the first line segment connecting a first point to a second point, the second line segment connecting the second point to a third point, the third line segment connecting the third point to a fourth point, the fourth line segment connecting the fourth point to a fifth point, and the fifth line segment connecting the fifth point to the first point, the first point having x, y coordinates of 0.32, 0.40, the second point having x, y coordinates of 0.36, 0.48, the third point having x, y coordinates of 0.43, 0.45, the fourth point having x, y coordinates of 0.42, 0.42, and the fifth point having x, y coordinates of 0.36, 0.38, (2) the second group of BSY LED chips 252 comprises at least one LED chip where if power is supplied to the second group it, emits light having x, y color coordinates which define a point which is within an area on a 1931 CIE Chromaticity Diagram enclosed by first, second, third, fourth and fifth line segments, the first line segment connecting a first point to a second point, the second line segment connecting the second point to a third point, the third line segment connecting the third point to a fourth point, the fourth line segment connecting the fourth point to a fifth point, and the fifth line segment connecting the fifth point to the first point, the first point having x, y coordinates of 0.32, 0.40, the second point having x, y coordinates of 0.36, 0.48, the third point having x, y coordinates of 0.43, 0.45, the fourth point having x, y coordinates of 0.42, 0.42, and the fifth point having x, y coordinates of 0.36, 0.38; and (3) the group of red LED chips 254 comprises at least one LED chip which, if power is supplied to the third string, emits light having a wavelength in the range of 600 nm to 640 nm. Different LED chips can emit different wavelengths of light such as between 610 nm and 635 nm, between 610 nm and 630 nm, between 615 nm and 625 nm.

Referring now to FIG. 7*a*, the groups of LED chips can be interconnected by the traces 246 (and wire bonds depending on the embodiment) in many different arrangements, such as by different serial and parallel interconnect combinations. In the embodiment shown, the traces 246 are on the top surface of the submount 242. This eliminates the need for traces to be placed such that the interconnects are between the LED chips on one or more layers interconnect layer. Additional layers of interconnects may be more costly and more complex to fabricate, and may reduce the ability to extract heat from the LED chips.

Referring now to FIGS. 9 and 10, in one embodiment, each of the different LED colors groups 250, 252, 254 is interconnected in respective first, second and third serial strings 260, 262, 264 so that an electrical signal applied to the string is conducted to each of the LED chips in the string. By having respective strings 260, 262, 264 for each of the LED colors, different electrical signals can be applied to each of the strings so that different electrical signals can be applied to the different LED color groups 250, 252, 254. This allows for control of the electrical signals so that the colors can emit light at different intensities. Accordingly, the emission of the LED component 240 can be tuned to the desired white light emission by applying different electrical signals to the LED colors color groups 250, 252, 254.

The LED component 240 can have many different contact arrangements for applying electrical signals to the strings 260, 262, 264 such as different ones on the top, bottom and side surfaces of the submount. For those embodiments having contact pads on the bottom surface, electrically conductive vias can be included through the submount for an electrical signal to pass from the bottom contact pad to the LED chips on the submount's top surface. In other embodiments, the electrical signal can run from the bottom-side contact pad to the LED chips along conductive paths on the submount's side surfaces.

The embodiment of the LED component 240 shown comprises contact pads on the top surface with first string contact pads 266*a*, 266*b* for applying an electrical signal to first string 260, second string contact pads 268*a*, 268*b* for applying an electrical signal to the second string 262, and third string contact pads 270*a*, 270*b* for applying an electrical signal to the third string 264. The contact pads 266*a-b*, 268*a-b* and 270*a-b* are along one of the edges of the submount 242, although it is understood that they can be in many different locations on the top surface. By arranging the contact pads in this way, the LED component 248 can be contacted along one edge and from one side of the component 240. By having the contacts on the top surface of the submount, it is not necessary to provide contacting features on the submount's bottom surface that can interfere with thermal dissipation, and it is not necessary to have multiple interconnect layers. The submount 248 can be directly mounted to a heat dissipating device, such as a heat sink, without intervening devices such as printed circuit boards (PCBs). This allows for improved thermal management for the LED component 248.

As best shown in FIG. 7*a*, each of the strings 260, 262, 264 also comprises an electrostatic discharge (ESD) pad 280*a*, 280*b*, 280*c* each of which is arranged to allow an ESD protection chip (not shown) to be mounted along a respective one of the strings 260, 262, 264. Each of the pads 280*a*, 280*b*, 280*c* is arranged adjacent to a trace from a different one of its string, and the ESD chip can be mounted to its one of the pads 280*a*, 280*b*, 280*c* with a wire bond to the adjacent trace of its string. For example, the ESD chip mounted to pad 280*a* can have a wire bond connection to adjacent trace on its string 264. When an ESD event occurs for instance on string 264, a spike in an electrical signal can be conducted on trace 246. The spike in voltage is fed through the ESD chip on pad 280*c*, through the wire bond to its string and out contact 278. The spike can then conduct off the LED component 240 without damaging the LED chips 248. The ESD chips on each of the other strings operate in much the same way to protect the LED chips 248 from an ESD event.

Different elements for the ESD protection chips, such as various vertical silicon (Si) Zener diodes, different LEDs arranged in parallel and reverse biased to the LED chips 248, surface mount varistors and lateral Si diodes can be provided. In one embodiment Zener diodes are utilized and mounted to the ESD chip pads 280*a*, 280*b*, 280*c* using known mounting techniques. These diodes are relatively small so that they do not cover an excessive area on the surface of the submount 242.

Each of the LED strings 260, 262, 264 can require a driving signal of more than 20 volts, so the ESD protection chips can only be activated at voltages substantially in excess of the driving signal. In some embodiments, the ESD chip can be activated with signals in excess of 30 volts, while in other embodiments, the ESD chips can be activated with signals in excess of 35 volts.

In some embodiments, the LED chips 248 should be packed as tightly as possible on the submount 242 to minimize the "dead space" between LED chips 248. There are certain factors that can limit how tightly the LEDs can be packed, such as the size of the die pads 244 and the traces 246, as well the ability of the LED component 240 to draw heat away from the LED chips 248. By tightly packing the LED chips 248, the LED component can experience increased natural mixing of the LED light, which can in turn reduce the need for diffusers or other light mixing devices that typically reduce overall emission efficiency of the LED component 240. Tightly packing can also provide smaller sized components that can have a form factor compatible with existing lamps, and can also provide the ability to shape the output beam into a particular angular distribution.

Embodiments according to the present inventive subject matter can comprise different numbers of LED chips 248, with the LED component 240 comprising twenty-six (26) LEDs. The LED chips 248 can comprise differing sized groups of LEDs emitting at different colors, with the LED component 240 comprising eight (8) of the first BSY LED group 250, eight (8) of the second BSY LED group 252, and (10) red emitting LEDs 254. The LEDs 248 can be arranged on the submount in many different ways, with the preferred LED component 240 having LED chips 248 arranged pursuant to certain guidelines.

First, the LED chips 248 should be positioned on the submount 242 so that the red LEDs 254 are not directly next to another one of the red LEDs 254. For purposes of describing the relationship between the red LEDs, "not directly next to" means that there are no parallel surfaces of the red LEDs 254 facing each other with no other intervening LED(s). In some embodiments, there may be a small portion of the red LEDs' parallel surfaces facing each other, but this should be less than 50% overlap of the parallel surfaces. In a preferred embodiment, the red LEDs 254 are diagonal to one another so that the closest point between adjacent LEDs are corners of the red LEDs 254. The red LEDs 254 should have first or second BSY LEDs 250, 252 adjacent to it, which promotes color mixing and reduces the appearance of red in the near and far field.

As a second guideline, the LED chips 248 should also be arranged so that as few as possible of the red LED chips 254 are on the perimeter of the LED chip array. In some embodiments, such as the one shown in FIG. 8, some red LED chips 254 can be on the perimeter, but in a preferred embodiment, less than 50% of the red LEDs 254 are on the perimeter. The LED component 240 is typically utilized in conjunction with a mirror that is adjacent to the LED chips array, and reflects light from the LED chips. Red LED chips 254 at the perimeter may be more prominently imaged by the reflector, and for each of the red LED chips 254 on the perimeter, the reflector gives the appearance of two red LED chips. This increases the likelihood of seeing red color spots in the array, both in the near and far field. Perimeter red LED chips 254 are also outside the optical center of the LED array, which reduces the natural mixing of red LED light with the other colors of LED light in the array.

As a third guideline, the LED chips 248 should also be arranged so that each of the red LED chips 254 has at least three LED chips from the first and second BSY LED chips 250, 252 adjacent to it. In a preferred embodiment, each red LED chip 254 has more than three adjacent to it. The first and second BSY chips 250, 252 need not be directly next to or adjacent the red LED, but can be diagonal or at angles to the red LED. This arrangement promotes mixing or balancing of the emission energy at the LED level, which in turn helps promote color mixing of the light from the different LEDs.

It is understood that different embodiments of components according to the fourth aspect of the present inventive subject matter can follow all three or different ones of the three guidelines to achieve the desired color mixing. For example, because of the number of LED chips in each of the LED chip groups it may not be possible to surround each of the red LED chips with three BSY chips. Yet, by utilizing the other guidelines, the desired color and color mixing can be achieved. The same can be true for embodiments that do not follow the other two of the guidelines.

Additionally, in some embodiments of the fourth aspect of the present inventive subject matter, the light from the solid state light emitters is mixed so as to provide color spatial uniformity where the variation of chromaticity in different directions (i.e., with a change in viewing angle) is within 0.004 from the weighted average point on the CIE 1976 (u',v') diagram in the near field and/or the far-field. In particular embodiments, the color spatial uniformity across the output beam of the device is less than 7 MacAdam ellipses, less than 5 MacAdam ellipses or less than 2 MacAdam ellipses on the 1931 CIE chromaticity diagram.

As mentioned above, in some embodiments heat does not spread efficiently into the submount, particularly those made of materials such as ceramic. When LED chips are provided on die pads that are generally around the middle of the submount's top surface, heat can concentrate around the area just below the LEDs and does not spread throughout the submount where it can dissipate. This can cause overheating of the LED chips which can limit the operating power level for the LED package.

To help dissipate heat, the LED package 240 can comprise a bottom metal layer 292 on the bottom surface of the submount 242. In different embodiments, the metal layer 292 can cover different portions of the submount's bottom surface, and in the embodiment shown, it covers substantially all of the bottom surface. The metal layer 292 is preferably made of a heat conductive material and is preferably in at least partial vertical alignment with the LED chips 248. In one embodiment, the metalized area is not in electrical contact with the elements on the top surface of the submount 242. Heat that can concentrate below the LED 248 chips will pass into the submount 242 directly below and around the LED 248. The metal layer can assist with heat dissipation by allowing this heat to spread from the concentrated area into the larger area provided by the metal layer, where it can dissipate more readily. The metal layer 292 can also have holes passing through it to the submount 242, with the holes relieving strain between the submount 242 and the metal layer 292 during fabrication and during operation. In other embodiments, thermally conductive vias or plugs can also be included that pass at least partially through the submount 242 and are in thermal contact with the metal layer 292. Heat that passes into the submount 242 can more readily pass to the metal layer 292 through the conductive vias 274 to further enhance thermal management. Other embodiments according to the present inventive subject matter can comprise different features to enhance thermal dissipation.

It is understood that different embodiments of the fourth aspect of the present inventive subject matter can also include features to further mix the colors from the LED chips 248. A diffuser can be included in conjunction with the LED component 240. Diffusers of this type are described in U.S. Provisional Patent Application No. 60/130,411, entitled "Light Source With Near Field Mixing," which is incorporated herein by reference.

Referring now to FIG. 11 shows another embodiment of an LED component 300 similar to LED component 240, and comprising a lens 255 and on the top surface of the lens 255, a diffuser can be included in the form of a diffuser film/layer 302 that is arranged to mix the light emission from the LED chips in the near field. That is, the diffuser mixes the emission of the LED chips 248, such that when the LED component 240 is viewed directly, the light from the discrete LED chips 248 is not separately identifiable. Instead, when the LED component 240 is viewed directly, it approximates a single light source under the lens 255.

The diffuser film 300 can comprise many different structures and materials arranged in different ways, and can comprise a conformally arranged coating over the lens 255. In different embodiments, commercially available diffuser films can be used such as those provided by Bright View Technologies, Inc. of Morrisville, N.C., Fusion Optix, Inc. of Cambridge, Mass., or Luminit, Inc. of Torrance, Calif. Some of these films can comprise diffusing microstructures that can comprise random or ordered micro lenses or geometric features and can have various shapes and sizes. The film 300 can be sized to fit over all or less than all of the lens 255 and can be bonded in place over the lens 255 using known bonding materials and methods. For example, the film 300 can be mounted to the lens with an adhesive, or could be film insert molded with the lens 255. In other embodiments, the diffuser film can comprise scattering particles, or can comprise index photonic features, alone or in combination with microstructures. The diffuser film can have many different thicknesses with some diffuser films available in a thickness in the range of from 0.005 inches to 0.125 inches, although films with other thicknesses can also be used.

By providing a diffuser film on the lens 255, light from the LED chips 248 can be mixed in the near field such that the light output of the LED component 240 is perceived as a combination of the light from the LED chips 248. In one embodiment, the combined light is a white light combination of light from the LED chips 248. Furthermore, the light in the far field is also perceived as a combination of light from the LED chips 248, such as white light. Thus, a low profile white light source can be provided from an array of different colored sources that appear as white when viewed directly.

In other embodiments, the diffuser/scattering pattern can be directly patterned onto the lens. Such a pattern may, for example, be random or a pseudo pattern of surface elements that scatter or disperse light passing through them. The diffuser can also comprise microstructures within the lens 255, or a diffuser film can be included within the lens 255.

FIG. 12 shows another embodiment of an LED component 320 according to the present inventive subject matter, and comprises LED chips 248 mounted on a submount 242, and a diffuser layer/film 322. In this embodiment, the diffuser comprises a diffuser layer/film 322 that can be made of the same materials as the diffuser film 300 described above. In this embodiment, however, the diffuser film 322 is remote from the lens, but not so remote as to provide substantial mixing from the reflection of light external to the lens. The diffuser film 322 can be any of different distances from the lens 255 such as 1 millimeter (mm). In other embodiments, the film 322 can be any of many different distances from the lens 255, such as, 5 mm, 10 mm or 20 mm, but other distances can also be used. Furthermore, the diffuser film can have different shapes. The shape may be selected based on the configuration of the lens 255. For example, a curved diffuser film that was spaced from but conformed to the shape of the lens could be provided as a dome over the lens. In one embodiment, the dome can be held in place by the perimeter of the device. In other embodiments, the diffuser can be supported on posts or other structures.

It is understood that diffuser arrangements according to the present inventive subject matter can be used with many different sized LED components with different numbers of LEDs in their LED array. The diffuser can likewise have many different sizes. By way of example, one embodiment of an LED component according to the present inventive subject matter can have a 12 mm by 15 mm submount, and can have 26 LEDs in its LED array. The array can be covered by a lens with a cone shaped diffuser mounted to the lens. The diffuser can have a height of approximately 8 mm and a base of approximately 17 mm.

Embodiments according to the present inventive subject matter may be utilized with light sources having the characteristics described in U.S. Pat. No. 7,213,940 and/or in U.S. Patent Application Publication Nos. 2007/0139920; 2007/0267983; 2007/0278503; 2007/0278934; 2007/0279903; 2008/0084685 and/or 2008/0106895, the entire disclosures of which are incorporated by reference herein, with the emission of the light sources mixed in the near field. Furthermore, the light sources may be provided as three or more strings of LEDs as described in U.S. patent application Ser. No. 12/248,220, filed on Oct. 9, 2008 (now U.S. Patent Publication No. 2009-0184616), the entirety of which is hereby incorporated by reference as if set forth in its entirety—see, e.g., FIG. 35 and the discussion relating thereto.

LED components according to the present inventive subject matter may be used with or without further optics. For example, light sources according to the present inventive subject matter may be used without an additional optic to provide a low profile under cabinet light. Light sources according to the present inventive subject matter could also include additional beam shaping, said provided in commercially available MR16 LED lamps. Also, reflective optics, including back reflective optics or forward reflecting optics could also be utilized. For example, the LED component or light source according to some embodiments of the present inventive subject matter could be utilized with the optics described in any of the following U.S. Pat. Nos. 5,924,785; 6,149,283; 5,578,998; 6,672,741; 6,722,777; 6,767,112; 7,001,047; 7,131,760; 7,178,937; 7,230,280; 7,246,921; 7,270,448; 6,637,921; 6,811,277; 6,846,101; 5,951,415; 7,097,334; 7,121,691; 6,893,140; 6,899,443 and 7,029,150, and in U.S. Patent Application Publication Nos. 2002/0136025; 2003/0063475; 2004/0155565; 2006/0262524; 2007/0189017 and 2008/0074885.

It is understood that the LED chips in the arrays can be arranged as one or more multiple multi-chip LED lamps as described in U.S. Patent Publication No. 2007/0223219 entitled "Multi-Chip Light Emitting Device for Providing High-CRI Warm White Light and Light Fixtures Including the Same", the entire disclosure of which is incorporated by reference as if set forth herein in its entirety.

While certain embodiments of the present inventive subject matter have been illustrated with reference to specific combinations of elements, various other combinations may also be provided without departing from the teachings of the present inventive subject matter. Thus, the present inventive subject matter should not be construed as being limited to the particular exemplary embodiments described herein and illustrated in the Figures, but may also encompass combinations of elements of the various illustrated embodiments.

Many alterations and modifications may be made by those having ordinary skill in the art, given the benefit of the present disclosure, without departing from the spirit and scope of the inventive subject matter. Therefore, it must be understood that the illustrated embodiments have been set forth only for the purposes of example, and that it should not be taken as limiting the inventive subject matter as defined by the following claims. The following claims are, therefore, to be read to include not only the combination of elements which are literally set forth but all equivalent elements for performing substantially the same function in substantially the same way to obtain substantially the same result. The claims are thus to be understood to include what is specifically illustrated and described above, what is conceptually equivalent, and also what incorporates the essential idea of the inventive subject matter.

Any two or more structural parts of the lighting devices described herein can be integrated. Any structural part of the lighting devices described herein can be provided in two or more parts (which are held together, if necessary). Similarly, any two or more functions can be conducted simultaneously, and/or any function can be conducted in a series of steps.

The invention claimed is:

1. A solid state self-ballasted lamp for operation on alternating current (AC) line voltage, the self-ballasted lamp comprising:

a solid state light source wherein the light emitted by the solid state light source has a Correlated Color Temperature (CCT) of 4000K or less and a Color Rendering Index (CRI) Ra of at least 90;

an electrical connector for connecting to a light socket;

an AC power supply electrically coupled to the electrical connector and configured to receive the AC line voltage and provide current to the solid state light source;

a reflector configured to receive light from the solid state light source and emit reflected light from an aperture of the reflector, the aperture measuring 4 inches or less, the reflected light having a beam angle of 30 degrees or less;

a thermal management system comprising at least a first heat pipe, the thermal management system configured to extract heat from the solid state light source and transfer the extracted heat to a surrounding environment and maintain a junction temperature of the solid state light source at or below a 25,000 hour rated lifetime junction temperature for the solid state light source in a 25° C. surrounding environment; and a sensor, wherein:

the self-ballasted lamp has a wall plug efficiency of at least 40 delivered lumens per watt, the sensor is in a region that receives direct light from the solid state light source, the sensor is within a conical region bounded by lines which each define an angle of ten degrees relative to an axis of light emitted from the solid state light source, and the sensor is mounted in or on the reflector.

2. A solid state self-ballasted lamp as recited in claim 1, wherein the thermal management system maintains the junction temperature of the solid state light source at or below a 35,000 hour rated lifetime junction temperature.

3. A solid state self-ballasted lamp as recited in claim 1, wherein the thermal management system maintains the junction temperature of the solid state light source below a 50,000 hour rated lifetime junction temperature.

4. A solid state self-ballasted lamp as recited in claim 1, wherein the thermal management system maintains the junction temperature of the solid state light source below a 50,000 hour rated lifetime junction temperature in a 35° C. surrounding environment.

5. A solid state self-ballasted lamp as recited in claim 1, wherein the reflector provides a beam angle of 20 degrees or less.

6. A solid state self-ballasted lamp as recited in claim 1, wherein the reflector provides a beam angle of 15 degrees or less.

7. A solid state self-ballasted lamp as recited in claim 1, wherein the reflector provides a beam angle of 10 degrees or less.

8. A solid state self-ballasted lamp as recited in claim 1, wherein the wall plug efficiency is at least 50 lumens per watt.

9. A solid state self-ballasted lamp as recited in claim 1, wherein the wall plug efficiency is at least 60 lumens per watt.

10. A solid state self-ballasted lamp as recited in claim 1, wherein the lamp is configured to have external dimensions of a PAR-38 lamp.

11. A solid state self-ballasted lamp as recited in claim 1, wherein the lamp is configured to have external dimensions of a PAR-30 lamp.

12. A solid state self-ballasted lamp as recited in claim 1, wherein the first heat pipe has an "S" shaped configuration.

13. A solid state self-ballasted lamp as recited in claim 1, wherein the solid state light source comprises a plurality of non-white, non-saturated light emitting diodes and a plurality of red or red-orange light emitting diodes.

14. A solid state self-ballasted lamp as recited in claim 1, wherein the light emitted by the reflector is perceived as white light in the near field.

15. A solid state self-ballasted lamp as recited in claim 1, wherein the solid state light source and the reflector are oriented in a back-reflector configuration.

16. A solid state self-ballasted lamp as recited in claim 1, wherein the sensor operably associated with the power supply so as to control at least one characteristic of the light output by the solid state light source responsive to a characteristic of the light detected by the sensor.

17. A solid state self-ballasted lamp as recited in claim 1, wherein the solid state light source comprises:

an array of one or more strings of light emitting diodes; and a lens on the array of light emitting diodes.

18. A solid state self-ballasted lamp as recited in claim 17, wherein the lamp further comprises a diffuser associated with the solid state light source to mix light from the array of light emitting diodes in the near field.

19. A solid state self-ballasted lamp as recited in claim 1, wherein the sensor is sensitive to only some wavelengths of visible light.

20. A solid state self-ballasted lamp as recited in claim 1, wherein the solid state light source is directly on a circuit board that is in direct contact with the first heat pipe.

21. A solid state self-ballasted lamp as recited in claim 1, wherein:

an edge of the reflector defines an opening, the lamp further comprises a lens, the lens covers the opening, the solid state light source is directly on the lens.

22. A lighting device, comprising:

a housing;

a solid state light source;

an electrical connector;

an AC power supply electrically coupled to the electrical connector;

a thermal management system configured to extract heat from the solid state light source and transfer the extracted heat to a surrounding environment and maintain a junction temperature of the solid state light source at or below a 25,000 hour rated lifetime junction temperature for the solid state light source in a 25° C. surrounding environment, the thermal management system comprising a heat pipe in thermal communication with the light source and the housing, the heat pipe having a thermal transfer region and at least a first thermal exchange region, at least a portion of the first thermal exchange region extending in a shape which follows at least a first portion of the housing;

a reflector configured to receive light from the solid state light source; and a sensor, wherein:

the solid state light source is directly on a heat plate that comprises a groove through which the heat pipe extends, the sensor is in a region that receives direct light from the solid state light source, the sensor is sensitive to only some wavelengths of visible light, and the sensor is mounted in or on the reflector.

23. A lighting device as recited in claim 22, wherein the lighting device has a wall plug efficiency of at least 40 delivered lumens per watt.

24. A solid state self-ballasted lamp as recited in claim 22, wherein:

light emitted from the solid state light source travels toward the reflector in a first direction, and light emitted from the solid state light source is reflected by the reflector and exits the lamp in a second direction, the second direction different from the first direction.

25. A solid state self-ballasted lamp as recited in claim 24, wherein light emitted from the solid state light source has an axis of light directed toward the reflector.

26. A solid state self-ballasted lamp as recited in claim 22, wherein the sensor is within a conical region bounded by lines which each define an angle of ten degrees relative to an axis of light emitted from the solid state light source.

27. A solid state self-ballasted lamp as recited in claim 22, wherein the heat plate is in direct contact with the first heat pipe.

28. A lighting device, comprising:

a housing having a substantially circular, substantially annular portion;

a reflector disposed within the housing;

a solid state light source, wherein the light emitted by the solid state light source has a Correlated Color Temperature (CCT) of 4000K or less and a Color Rendering Index (CRI) Ra of at least 90;

an electrical connector for connecting to a light socket;

an AC power supply electrically coupled to the electrical connector and configured to receive the AC line voltage and provide current to the solid state light source;

a thermal management system; and at least a first sensor, the reflector configured to receive light from the solid state light source and emit reflected light from an aperture of the reflector, the aperture measuring 4 inches or less, the reflected light having a beam angle of 30 degrees or less, the thermal management system comprising at least a first heat pipe in thermal communication with the light emitter, the thermal management system configured to extract heat from the solid state light source and transfer the extracted heat to a surrounding environment, the heat pipe having an "S" shaped configuration, the heat pipe comprising at least a first internal space and at least one fluid in the first internal space, the heat pipe having a thermal transfer region and at least a first thermal exchange region, the first internal space in the first thermal exchange region extending in a shape which follows at least a first portion of the substantially circular, substantially annular portion of the housing, the first portion extending at least 50 degrees along a circumference of the substantially annular portion of the housing, the reflector facing the solid state light source, at least a portion of the thermal transfer region in a path of light reflected by the reflector, the first internal space in the thermal transfer region extending in a shape which extends along at least a portion of a diameter of the substantially circular, substantially annular portion of the housing, the first sensor in a region that receives direct light from the light emitter when the light emitter is emitting light, the first sensor sensitive to only some wavelengths of visible light.

* * * * *